US009141011B2

(12) United States Patent
Watanabe et al.

(10) Patent No.: US 9,141,011 B2
(45) Date of Patent: Sep. 22, 2015

(54) METHOD FOR PRODUCING TONER FOR ELECTROSTATIC IMAGE DEVELOPMENT

(71) Applicant: Kao Corporation, Chuo-ku (JP)

(72) Inventors: Shogo Watanabe, Izumiotsu (JP); Takeshi Ashizawa, Wakayama (JP); Takashi Kubo, Wakayama (JP); Norihiro Hirai, Wakayama (JP)

(73) Assignee: Kao Corporation, Chuo-ku (JP)

( * ) Notice: Subject to any disclaimer, the term of this patent is extended or adjusted under 35 U.S.C. 154(b) by 42 days.

(21) Appl. No.: 14/046,021

(22) Filed: Oct. 4, 2013

(65) Prior Publication Data

US 2014/0120465 A1 May 1, 2014

(30) Foreign Application Priority Data

Oct. 25, 2012 (JP) ..... 2012-235643
Oct. 25, 2012 (JP) ..... 2012-235644
Oct. 25, 2012 (JP) ..... 2012-235645

(51) Int. Cl.
*G03G 9/08* (2006.01)
*G03G 9/087* (2006.01)

(52) U.S. Cl.
CPC ..... *G03G 9/08755* (2013.01); *G03G 9/081* (2013.01); *G03G 9/08782* (2013.01); *G03G 9/08797* (2013.01)

(58) Field of Classification Search
CPC G03G 9/081; G03G 9/08755; G03G 9/08782
USPC ..... 430/137.18, 109.4, 108.8
See application file for complete search history.

(56) References Cited

U.S. PATENT DOCUMENTS 7,723,002 B2 * 5/2010 Shimokusa et al. ..... 430/108.8
2006/0029875 A1 2/2006 Kamiyoshi et al.
2007/0207401 A1 9/2007 Shirai et al.
2009/0069530 A1 3/2009 Kimura et al.
2009/0156784 A1 6/2009 Kubo et al.
2010/0239970 A1 9/2010 Yoo et al.
2012/0184700 A1 7/2012 Fukuri et al.
2013/0171555 A1 7/2013 Kubo et al.

FOREIGN PATENT DOCUMENTS

EP 2 634 634 A1 9/2013
JP 05-134453 A 5/1993
JP 05-134454 A 5/1993
JP 06-027727 A 2/1994
JP 2005-308995 A 11/2005
JP 2007-292816 A 11/2007
JP 2007-292820 A 11/2007
JP 2010-008579 A 1/2010
JP 2012-008371 A 1/2012
WO WO 2009/066849 A1 5/2009

OTHER PUBLICATIONS

Extended European Search Report issued Jan. 23, 2014 in Patent Application No. 13190020.1.

* cited by examiner

*Primary Examiner* — Mark A Chapman
(74) *Attorney, Agent, or Firm* — Oblon, McClelland, Maier & Neustadt, L.L.P.

(57) ABSTRACT

A method for producing a toner for electrostatic image development including the step of melt-kneading a mixture containing a resin binder and a wax, wherein the resin binder contains an amorphous polyester (A) obtained by polycondensing an alcohol component containing an aliphatic diol (a) having 3 or 4 carbon atoms, the aliphatic diol having a hydroxyl group bonded to a secondary carbon atom, and an aliphatic diol (b) containing one or more α,ω-linear alkanediols having 2, 4, 6 or 8 carbon atoms, and a carboxylic acid component. The toner for electrostatic image development can be suitably used in, for example, the development or the like of latent image formed in an electrostatic development method, an electrostatic recording method, an electrostatic printing method, or the like.

20 Claims, No Drawings

METHOD FOR PRODUCING TONER FOR ELECTROSTATIC IMAGE DEVELOPMENT

FIELD OF THE INVENTION

The present invention relates to a toner for electrostatic image development usable in developing latent images formed in, for example, an electrostatic development method, an electrostatic recording method, an electrostatic printing method, or the like, and a method for producing the toner.

BACKGROUND OF THE INVENTION

From the viewpoint of energy conservation, i.e. reducing energy consumption in the fusing step, together with the advancement of miniaturization, speeding-up, high-quality image formation of the electrophotographic apparatus in the recent years, an improvement in low-temperature fusing ability of the toner is earnestly in demand.

In order to meet this demand, for example, it is proposed in Patent Document 1, i.e. Japanese Patent Laid-Open No. 2005-308995, that a toner having excellent low-temperature fusing ability, and also having favorable pulverizability and storage property can be produced according to a method for producing a toner including the steps of melt-kneading raw materials containing two or more kinds of polyesters, a heat-treating step, a pulverizing step, and a classifying step, wherein the two or more kinds of the polyesters contain at least one kind of an amorphous polyester, and wherein the heat-treating step is carried out at temperatures and time that satisfy a particular relationship.

Patent Document 2, i.e. Japanese Patent Laid-Open No. 2012-8371, discloses that a polyester-based resin for a toner obtained by polycondensation reaction of, in addition to an alcohol component and a carboxylic acid component, a reaction product obtained by reacting a specified aromatic compound having an aromatic ring with a vinylene group, and a carboxylic acid having a reactive unsaturated group can improve triboelectric stability under high-temperature, high-humidity environmental conditions as a resin binder of a toner for electrophotography, while maintaining low-temperature fusing ability, storage property and durability of the toner.

Further, Patent Document 3, i.e. Japanese Patent Laid-Open No. 2007-292816, and Patent Document 4, i.e. Japanese Patent Laid-Open No. 2007-292820, disclose that a toner containing a polyester for a toner obtained by polycondensing an alcohol component containing an aliphatic polyhydric alcohol and a carboxylic acid component containing a (meth)acrylic acid-modified rosin or a fumaric acid-modified rosin has excellent low-temperature fusing ability, offset resistance, and storage property, and has reduced odor generation.

On the other hand, with the growth of the print-on-demand markets in the recent years, the demands for high-quality image formation for electrophotographic techniques are ever more increasing. Especially, when color printing is carried out in electrophotographic method, high gloss is earnestly desired.

In addition, for the purpose of efficiently giving electric charges to a toner which is an electrophotographic developer, a charge control resin has been used.

For example, a styrene-acrylic copolymer has been known as a charge control resin, and the styrene-acrylic copolymer has excellent electric charge-donating ability, so that the copolymer is desired to be utilized as a charge control agent of the toner. However, the copolymer is a high-molecular weight compound, so that it is more likely to cause dispersion failure in the toner.

In view of the above, it is disclosed that a toner in which a resin binder having a specified storage modulus and a styrene-acrylic copolymer, which is a charge control agent, are used provides favorable triboelectric chargeability, prevents the generation of background fogging, and gives excellent solid image quality, see Patent Document 5, i.e. Japanese Patent Laid-Open No. 2010-008579.

SUMMARY OF THE INVENTION

The present invention relates to:

[1] a method for producing a toner for electrostatic image development including the step of melt-kneading a mixture containing a resin binder and a wax, wherein the resin binder contains an amorphous polyester (A) obtained by polycondensing an alcohol component containing an aliphatic diol (a) having 3 or 4 carbon atoms, the aliphatic diol having a hydroxyl group bonded to a secondary carbon atom, and an aliphatic diol (b) containing one or more α,ω-linear alkanediols having 2, 4, 6 or 8 carbon atoms, and a carboxylic acid component, a molar ratio of the aliphatic diol (a) to the aliphatic diol (b), i.e. aliphatic diol (a)/aliphatic diol (b), being from 95/5 to 55/45, and wherein the wax has a melting point of from 60° to 120° C., and a content of the wax being from 0.2 to 13 parts by mass, based on 100 parts by mass of the resin binder; and

[2] a toner for electrostatic image development, obtained by the method of the above [1].

DETAILED DESCRIPTION OF THE INVENTION

It has been known that low-temperature fusing ability and gloss of the toner are improved by using a crystalline polyester in addition to an amorphous resin as a resin binder due to its melting properties. However, if the content of the crystalline polyester is increased, resin strength may be lowered in some cases, and a part of the crystalline polyester is amorphized by compatibilizing the crystalline polyester and the amorphous resin during melt-kneading. As a result, it has a disadvantage that heat-resistant storage property, which is stability during high-temperature storage, is lowered. In order to cope with the disadvantage, some proposals have been made such as heat treatment is carried out after the melt-kneading step, thereby reproducing the crystallinity of the polyester, cf. Patent Document 1, and monomer components to be used are varied, cf. Patent Documents 2 to 4. However, there are rooms for improvements from the aspects of satisfying all of low-temperature fusing ability, gloss, high-temperature offset resistance, and heat-resistant storage property, which can meet the demands in speeding up and high-quality image formation.

In addition, the toner described in Patent Document 5 has suppressed background fogging, but has a disadvantage that gloss is low.

The present invention relates to a toner for electrostatic image development having excellent low-temperature fusing ability and heat-resistant storage property, and a method for producing the same.

Also, the present invention relates to a toner for electrostatic image development having excellent gloss and high-temperature offset resistance, and a method for producing the same.

Further, the present invention relates to a toner for electrostatic image development having excellent gloss and background fogging suppression, and a method for producing the same.

According to the method of the present invention, a toner for electrostatic image development having excellent low-temperature fusing ability and heat-resistant storage property is obtained.

Also, in the method of the present invention, a toner for electrostatic image development having excellent gloss and high-temperature offset resistance is obtained by further using a crystalline resin as a resin binder.

Further, in the method of the present invention, a toner for electrostatic image development having excellent gloss and background fogging suppression is obtained by further using a charge control resin.

The method of the present invention is a method for producing a toner for electrostatic image development, including the step of melt-kneading a mixture containing a resin binder and a wax, and one of the features resides in that the resin binder contains an amorphous polyester (A) obtained by polycondensing an alcohol component containing an aliphatic diol (a) having 3 or 4 carbon atoms, the aliphatic diol having a hydroxyl group bonded to a secondary carbon atom, and an aliphatic diol (b) containing one or more α,ω-linear alkanediols having 2, 4, 6 or 8 carbon atoms, and a carboxylic acid component. The toner for electrostatic image development obtained by the method of the present invention exhibits some effects of having excellent low-temperature fusing ability and heat-resistant storage property.

Although the reasons why the effects as described above are exhibited are not certain, they are considered to be as follows:

A component originating from an aliphatic diol (b) comprising an α,ω-linear alkanediol in the amorphous polyester (A) is likely to have an orderly structure so that the component is likely to be crystallized. However, by including a component originating from an aliphatic diol (a) having 3 or 4 carbon atoms, the aliphatic diol having a hydroxyl group bonded to a secondary carbon atom, in a specified amount, the formation of an orderly structure is appropriately eased to an extent that a melting point is not shown. As a result, low-temperature fusing ability of the toner is improved, and at the same time the lowering of heat-resistant storage property can be suppressed.

Further, when toner components such as an amorphous polyester (A) and a wax and the like are melt-kneaded, by including a wax having a specified melting point in a specified amount, the dispersion of the components such as a wax into a resin binder is facilitated, so that an orderly structure of a polyester satisfying both low-temperature fusing ability and heat-resistant storage property is maintained, and at the same time components of the toner particles are homogenized. As a result, it is considered that the low-temperature fusing ability is further improved, and at the same time the heat-resistant storage property is improved, so that both can be satisfied.

Further, a part originating from the aliphatic diol (b) comprising an α,ω-linear alkanediol in the amorphous polyester (A) and the crystalline resin are more likely to take an orderly structure even after melting the toner, so that ruggedness is less likely to be formed on the fixed images, whereby fixed images having a high gloss can be obtained.

[Resin Binder]

The resin binder used in the present invention contains an amorphous polyester (A) obtained by polycondensing an alcohol component containing an aliphatic diol (a) having 3 or 4 carbon atoms, the aliphatic diol having a hydroxyl group bonded to a secondary carbon atom, and an aliphatic diol (b) containing one or more α,ω-linear alkanediols having 2, 4, 6 or 8 carbon atoms, and a carboxylic acid component.

The content of the amorphous polyester (A) is preferably 80% by mass or more, more preferably 90% by mass or more, and even more preferably 95% by mass or more, of the resin binder, from the viewpoint of improving gloss, low-temperature fusing ability, and heat-resistant storage property of the toner, and suppressing background fogging, and it is even more preferable to use an amorphous polyester (A) alone as a resin binder. However, a resin other than the amorphous polyester (A) may be contained within the range that would not impair the effects of improving gloss, low-temperature fusing ability, and heat-resistant storage property of the toner, and suppressing background fogging. Other resin binders include other polyesters, vinyl resins, epoxy resins, polycarbonates, polyurethanes, and the like.

Here, in the present invention, the crystallinity of the resin is expressed by a crystallinity index defined by a value of a ratio of a softening point to a highest temperature of endothermic peak determined by a scanning differential calorimeter, i.e. softening point/highest temperature of endothermic peak. The crystalline resin is a resin having a crystallinity index of from 0.6 to 1.4, preferably from 0.7 to 1.2, and more preferably from 0.9 to 1.2, and the amorphous resin is a resin having a crystallinity index exceeding 1.4 or less than 0.6. The crystallinity of the resin can be adjusted by the kinds of the raw material monomers and ratios thereof, production conditions, e.g., reaction temperature, reaction time, cooling rate, and the like. Here, the highest temperature of endothermic peak refers to a temperature of the peak on the highest temperature side among endothermic peaks observed. When a difference between the highest temperature of endothermic peak and the softening point is within 20° C., the highest temperature of endothermic peak is defined as a melting point. When the difference between the highest temperature of endothermic peak and the softening point exceeds 20° C., the peak is a peak temperature ascribed to a glass transition.

The aliphatic diol (a) having 3 or 4 carbon atoms, the aliphatic diol having a hydroxyl group bonded to a secondary atom includes 1,2-propanediol, 1,2-butanediol, 1,3-butanediol, and 2,3-butanediol, and at least one kind thereof is used. 1,2-Propanediol and 2,3-butanediol are preferred, and 1,2-propanediol is more preferred, from the viewpoint of improving gloss, low-temperature fusing ability, and heat-resistant storage property of the toner, and suppressing background fogging.

The content of the aliphatic diol (a) is preferably 35% by mol or more, more preferably 55% by mol or more, even more preferably 60% by mol or more, even more preferably 65% by mol or more, and even more preferably 70% by mol or more, of the alcohol component of the amorphous polyester (A), from the viewpoint of improving heat-resistant storage property of the toner. Also, the content of the aliphatic diol (a) is preferably 95% by mol or less, more preferably 93% by mol or less, even more preferably 90% by mol or less, even more preferably 85% by mol or less, and even more preferably 75% by mol or less, of the alcohol component, from the viewpoint of improving gloss and low-temperature fusing ability of the toner, and suppressing background fogging.

The content of the aliphatic diol (a) is preferably from 35 to 95% by mol, more preferably from 55 to 95% by mol, even more preferably from 60 to 93% by mol, even more preferably from 65 to 90% by mol, even more preferably from 65 to 85% by mol, even more preferably from 70 to 85% by mol, and even more preferably from 70 to 75% by mol, of the alcohol component of the amorphous polyester (A), from the viewpoint of improving gloss, low-temperature fusing ability, and heat-resistant storage property of the toner, and suppressing background fogging.

The content of the aliphatic diol (a) is preferably from 35 to 95% by mol, more preferably from 35 to 93% by mol, even more preferably from 35 to 90% by mol, even more preferably from 35 to 85% by mol, and even more preferably from 35 to 75% by mol, of the alcohol component of the amorphous polyester (A), from the viewpoint of improving gloss of the toner, and suppressing background fogging.

Here, the content of the above-mentioned aliphatic diol (a) in a case where the resin binder contains amorphous polyester (A)'s in a plural number can be obtained by the sum of the products of a content of the aliphatic diol (a) in the alcohol component of each of the amorphous polyester (A)'s and a mass percentage of each of the amorphous polyester (A)'s.

When the resin binder contains a polyester other than the amorphous polyester (A), the content of the aliphatic diol (a) is preferably from 35 to 95% by mol, more preferably from 55 to 95% by mol, even more preferably from 60 to 93% by mol, even more preferably from 65 to 90% by mol, even more preferably from 65 to 85% by mol, even more preferably from 70 to 85% by mol, and even more preferably from 70 to 75% by mol, of the alcohol component of all the polyesters contained in the resin binder, from the viewpoint of improving gloss, low-temperature fusing ability, and heat-resistant storage property of the toner, and suppressing background fogging.

Here, the content of the aliphatic diol (a) of the alcohol component of all the polyesters can be obtained by the sum of the products of a content of the aliphatic diol (a) of the alcohol component of each of the polyesters and a mass percentage of each of the polyesters.

The aliphatic diol (b) containing one or more α,ω-linear alkanediols having 2, 4, 6 or 8 carbon atoms includes ethanediol, 1,4-butanediol, 1,6-hexanediol, and 1,8-octanediol, and at least one kind thereof is used. 1,4-Butanediol, 1,6-hexanediol, and 1,8-octanediol are preferred, and 1,4-butanediol is more preferred, from the viewpoint of improving low-temperature fusing ability and heat-resistant storage property of the toner.

The content of the aliphatic diol (b) is preferably 5% by mol or more, more preferably 7% by mol or more, even more preferably 10% by mol or more, and even more preferably 15% by mol or more, of the alcohol component of the amorphous polyester (A), from the viewpoint of improving gloss and low-temperature fusing ability of the toner, and suppressing background fogging. In addition, the content of the aliphatic diol (b) is preferably 65% by mol or less, more preferably 45% by mol or less, even more preferably 40% by mol or less, even more preferably 35% by mol or less, and even more preferably 30% by mol or less, of the alcohol component, from the viewpoint of improving heat-resistant storage property of the toner.

The content of the aliphatic diol (b) is preferably from 5 to 65% by mol, more preferably from 5 to 45% by mol, even more preferably from 7 to 40% by mol, even more preferably from 10 to 35% by mol, even more preferably from 15 to 35% by mol, even more preferably from 15 to 30% by mol, and even more preferably from 25 to 30% by mol, of the alcohol component of the amorphous polyester (A), from the viewpoint of improving gloss, low-temperature fusing ability, and heat-resistant storage property of the toner, and suppressing background fogging.

The content of the aliphatic diol (b) is preferably from 5 to 65% by mol, more preferably from 7 to 65% by mol, even more preferably from 10 to 65% by mol, even more preferably from 15 to 65% by mol, and even more preferably from 25 to 65% by mol, of the alcohol component of the amorphous polyester (A), from the viewpoint of improving gloss of the toner, and suppressing background fogging.

Here, the content of the above-mentioned aliphatic diol (b), in a case where the resin binder contains amorphous polyester (A)'s in a plural number, can be obtained by the sum of the products of a content of the aliphatic diol (b) in the alcohol component of each of the amorphous polyester (A)'s and a mass percentage of each of the amorphous polyester (A)'s.

When the resin binder contains a polyester other than the amorphous polyester (A), the content of the aliphatic diol (b) is preferably from 5 to 65% by mol, more preferably from 5 to 45% by mol, even more preferably from 7 to 40% by mol, even more preferably from 10 to 35% by mol, even more preferably from 15 to 35% by mol, even more preferably from 15 to 30% by mol, and even more preferably from 25 to 30% by mol, of the alcohol component of all the polyesters contained in the resin binder, from the viewpoint of improving gloss, low-temperature fusing ability, and heat-resistant storage property of the toner, and suppressing background fogging.

Here, the content of the above-mentioned aliphatic diol (b) in the alcohol component of all the polyesters can be obtained by the sum of the products of a content of the aliphatic diol (b) in the alcohol component of each of the polyesters and a mass percentage of each of the polyesters.

A total content of the aliphatic diol (a) and the aliphatic diol (b) in the alcohol component is preferably 80% by mol or more, more preferably 90% by mol or more, even more preferably 95% by mol or more, and even more preferably substantially 100% by mol, of the alcohol component of the amorphous polyester (A), from the viewpoint of improving gloss, low-temperature fusing ability, and heat-resistant storage property of the toner, and suppressing background fogging.

A molar ratio of the aliphatic diol (a) to the aliphatic diol (b) in the alcohol component of the amorphous polyester (A), i.e. the aliphatic diol (a)/aliphatic diol (b), is from 95/5 to 55/45, preferably from 93/7 to 55/45, more preferably from 85/15 to 55/45, and even more preferably from 75/25 to 55/45, from the viewpoint of improving low-temperature fusing ability of the toner.

A molar ratio of the aliphatic diol (a) to the aliphatic diol (b) in the alcohol component of the amorphous polyester (A), i.e. the aliphatic diol (a)/aliphatic diol (b), is from 95/5 to 55/45, preferably from 93/7 to 60/40, more preferably from 90/10 to 65/35, even more preferably from 85/15 to 65/35, even more preferably from 85/15 to 70/30, and even more preferably from 75/25 to 70/30, from the viewpoint of improving gloss, low-temperature fusing ability, and heat-resistant storage property of the toner, and suppressing background fogging.

When the resin binder contains a polyester other than the amorphous polyester (A), the molar ratio of the aliphatic diol (a) to the aliphatic diol (b) in the alcohol component of all the polyesters, i.e. the aliphatic diol (a)/aliphatic diol (b), is preferably from 95/5 to 55/45, more preferably from 93/7 to 60/40, even more preferably from 90/10 to 65/35, even more preferably from 85/15 to 65/35, even more preferably from 85/15 to 70/30, and even more preferably from 75/25 to 70/30, from the viewpoint of improving gloss, low-temperature fusing ability, and heat-resistant storage property of the toner, and suppressing background fogging.

The alcohol component other than the above includes dihydric alcohols such as diols having 3 to 20 carbon atoms, and preferably 3 to 15 carbon atoms; and an alkylene oxide adduct of bisphenol A represented by the formula (I):

(I)

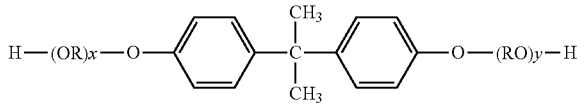

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4;
and the like.

The trihydric or higher polyhydric alcohol includes trihydric or higher polyhydric alcohols having 3 to 20 carbon atoms, preferably 3 to 10 carbon atoms. Specific examples thereof include sorbitol, 1,4-sorbitan, pentaerythritol, glycerol, trimethylolpropane, and the like.

In the present invention, the carboxylic acid component of the amorphous polyester (A) contains a dicarboxylic or higher polycarboxylic acid compound, from the viewpoint of improving gloss, low-temperature fusing ability, and heat-resistant storage property of the toner, and suppressing background fogging.

The dicarboxylic acid compound includes, for example, dicarboxylic acids having 3 to 30 carbon atoms, preferably 3 to 20 carbon atoms, and more preferably 3 to 10 carbon atoms, and derivatives thereof such as acid anhydrides thereof, alkyl esters thereof of which alkyl group has 1 to 3 carbon atoms, and the like. Specific examples are preferably aromatic dicarboxylic acid compounds and aliphatic dicarboxylic acid compounds, and the aromatic dicarboxylic acid compounds are more preferred, from the viewpoint of improving low-temperature fusing ability and heat-resistant storage property of the toner. The aromatic dicarboxylic acid includes phthalic acid, isophthalic acid, terephthalic acid, and the like, among which terephthalic acid is preferred. The aliphatic dicarboxylic acid includes fumaric acid, maleic acid, succinic acid, glutaric acid, adipic acid, sebacic acid, succinic acid substituted with an alkyl group having 1 to 20 carbon atoms or an alkenyl group having 2 to 20 carbon atoms, among which fumaric acid is preferred, from the viewpoint of improving heat-resistant storage property of the toner.

The content of the dicarboxylic acid compound is preferably from 60 to 100% by mol, more preferably from 70 to 100% by mol, even more preferably from 80 to 100% by mol, and even more preferably from 85 to 100% by mol, of the carboxylic acid component of the amorphous polyester (A), from the viewpoint of improving gloss, low-temperature fusing ability, and heat-resistant storage property of the toner, and suppressing background fogging.

Here, the content of the above-mentioned dicarboxylic acid compound, in a case where the resin binder contains amorphous polyester (A)'s in a plural number, can be obtained by the sum of the products of a content of the dicarboxylic acid compound in the carboxylic acid component of each of the amorphous polyester (A)'s and a mass percentage of each of the amorphous polyester (A)'s.

When the resin binder contains a polyester other than the amorphous polyester (A), the content of the dicarboxylic acid compound is preferably from 60 to 100% by mol, more preferably from 70 to 100% by mol, even more preferably from 80 to 100% by mol, and even more preferably from 85 to 100% by mol, of the carboxylic acid component of all the polyesters contained in the resin binder, from the viewpoint of improving gloss, low-temperature fusing ability, and heat-resistant storage property of the toner, and suppressing background fogging.

Here, the content of the above-mentioned dicarboxylic acid compound in the carboxylic acid component of all the polyesters can be obtained by the sum of the products of a content of the dicarboxylic acid compound in the carboxylic acid component of each of the polyesters and a mass percentage of each of the polyesters.

The tricarboxylic or higher polycarboxylic acid compound includes, for example, tricarboxylic or higher polycarboxylic acids having 4 to 30 carbon atoms, preferably 4 to 20 carbon atoms, and more preferably 4 to 10 carbon atoms, derivatives thereof, such as acid anhydrides thereof and alkyl esters thereof of which alkyl group has 1 to 3 carbon atoms, and the like. Specific examples include 1,2,4-benzenetricarboxylic acid, i.e. trimellitic acid, 2,5,7-naphthalenetricarboxylic acid, 1,2,4,5-benzenetetracarboxylic acid, i.e. pyromellitic acid, and the like. 1,2,4-Benzenetricarboxylic acid, i.e. trimellitic acid, and an anhydride thereof are preferred, and 1,2,4-benzenetricarboxylic acid anhydride, i.e. trimellitic anhydride, is more preferred, from the viewpoint of improving gloss, low-temperature fusing ability, and heat-resistant storage property of the toner, and suppressing background fogging.

The content of the tricarboxylic or higher polycarboxylic acid compound is preferably 40% by mol or less, more preferably 30% by mol or less, even more preferably 20% by mol or less, and even more preferably 15% by mol or less, of the carboxylic acid component, from the viewpoint of improving gloss, low-temperature fusing ability, and heat-resistant storage property of the toner, and suppressing background fogging.

Also, the alcohol component may properly contain a monohydric alcohol, and the carboxylic acid component may properly contain a monocarboxylic acid compound, from the viewpoint of adjusting the softening point of the polyester.

An equivalent ratio, i.e. COOH group or groups/OH group or groups, of the carboxylic acid component and the alcohol component in the amorphous polyester (A) is preferably from 0.70 to 1.15, and more preferably from 0.75 to 1.10, from the viewpoint of reducing an acid value of the polyester.

The polycondensation reaction of the alcohol component and the carboxylic acid component can be carried out by polycondensing the components in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification catalyst is used in an amount of preferably from 0.01 to 1.5 parts by mass, and more preferably from 0.1 to 1.0 part by mass, based on 100 parts by mass of a total amount of the alcohol component and the carboxylic acid component. The esterification promoter includes gallic acid, and the like. The esterification promoter is used in an amount of preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The polymerization inhibitor is used in an amount of preferably from 0.001 to 0.5 parts by mass, and more preferably from 0.01 to 0.1 parts by mass, based on 100 parts by mass of a total amount of the alcohol component and the carboxylic acid component.

The amorphous polyester (A) has a softening point of preferably 80° C. or higher, more preferably 100° C. or higher, even more preferably 110° C. or higher, and even more preferably 120° C. or higher, from the viewpoint of improving high-temperature offset resistance and heat-resistant storage property of the toner. Also, the amorphous polyester (A) has a softening point of preferably 170° C. or lower, more preferably 160° C. or lower, even more preferably 150° C. or lower, even more preferably 145° C. or lower, and even more preferably 140° C. or lower, from the viewpoint of improving gloss and low-temperature fusing ability of the toner, and suppressing background fogging.

The softening point of the amorphous polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

The amorphous polyester (A) has a highest temperature of endothermic peak of preferably 50° C. or higher, from the viewpoint of improving high-temperature offset resistance and heat-resistant storage property of the toner. Moreover, the amorphous polyester (A) has a highest temperature of endothermic peak of preferably 90° C. or lower, more preferably 85° C. or lower, and even more preferably 80° C. or lower, from the viewpoint of improving gloss and low-temperature fusing ability of the toner, and suppressing background fogging.

The highest temperature of endothermic peak of the amorphous polyester (A) can be controlled by the kinds, compositional ratios or the like of the alcohol component or the carboxylic acid component.

The amorphous polyester (A) has a glass transition temperature of preferably 50° C. or higher, more preferably 60° C. or higher, and even more preferably 65° C. or higher, from the viewpoint of improving heat-resistant storage property and high-temperature offset resistance of the toner. Moreover, the amorphous polyester (A) as a glass transition temperature of preferably 90° C. or lower, more preferably 85° C. or lower, and even more preferably 80° C. or lower, from the viewpoint of improving gloss and low-temperature fusing ability of the toner, and suppressing background fogging. Here, the glass transition temperature is a physical property intrinsically owned by an amorphous resin.

The glass transition temperature of the amorphous polyester (A) can be controlled by the kinds, compositional ratios and the like of the alcohol component or the carboxylic acid component.

The amorphous polyester (A) has an acid value of preferably 60 mgKOH/g or less, and more preferably 50 mgKOH/g or less, from the viewpoint of improving high-temperature offset resistance and triboelectric chargeability of the toner. In addition, the amorphous polyester (A) has an acid value of preferably 30 mgKOH/g or less, and more preferably 20 mgKOH/g or less, from the viewpoint of improving high-temperature offset resistance and heat-resistant storage property of the toner, and from the viewpoint of improving triboelectric chargeability of the toner, and suppressing background fogging.

The acid value of the amorphous polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

In the present invention, the amorphous polyester (A) alone may be used as a resin binder (First Embodiment). However, two or more kinds of the amorphous polyesters may be used, from the viewpoint of improving gloss, low-temperature fusing ability, and heat-resistant storage property of the toner, and suppressing background fogging, and from the viewpoint of improving productivity.

In addition, in the present invention, a crystalline resin is further used as a resin binder, whereby gloss and high-temperature offset resistance can be improved.

Specifically, the resin binder may be in an embodiment where the resin binder contains a crystalline resin and an amorphous resin, wherein the amorphous resin contains the amorphous polyester (A) (Second Embodiment). According to this embodiment, the toner for electrostatic image development obtained by the method of the present invention exhibits some effects of having even more excellent gloss and high-temperature offset resistance.

The reasons why the effects described above are exhibited are not fully elucidated, but they are presumably as follows.

A component originating from an aliphatic diol (b) comprising an α,ω-linear alkanediol in the amorphous polyester (A) is likely to have an orderly structure so that the component is likely to be crystallized. However, by including a component originating from an aliphatic diol (a) having 3 or 4 carbon atoms, the aliphatic diol having a hydroxyl group bonded to a secondary carbon atom, in a specified amount, the formation of an orderly structure is accomplished to an extent that a melting point is not shown. Even in a case where the amorphous polyester and a crystalline resin are compatibilized, it is made possible to appropriately suppress the lowering of the viscosity in the compatibilized part. Therefore, as compared to a case where conventional amorphous resin and crystalline resin are used, high-temperature offset resistance is more favorable without using a high-softening point resin, and gloss is also improved.

The content of the amorphous polyester (A) is preferably 80% by mass or more, more preferably 90% by mass or more, and even more preferably 95% by mass or more, of the amorphous resin, from the viewpoint of improving gloss, high-temperature offset resistance, low-temperature fusing ability, and heat-resistant storage property of the toner, and even more preferably the amorphous polyester (A) alone being used as the amorphous resin. An amorphous resin other than the amorphous polyester (A) may be contained within the range that would not impair the effects of improving gloss and high-temperature offset resistance of the toner. Other amorphous resins include other amorphous polyesters, vinyl resins, epoxy resins, polycarbonates, polyurethanes, and the like.

In addition, the content of the amorphous polyester (A) is preferably 55% by mass or more, more preferably 60% by mass or more, even more preferably 70% by mass or more, and even more preferably 75% by mass or more, of the resin binder, from the viewpoint of improving high-temperature offset resistance and heat-resistant storage property of the toner. Also, the content of the amorphous polyester (A) is preferably 95% by mass or less, more preferably 90% by mass or less, and even more preferably 85% by mass or less, of the resin binder, from the viewpoint of improving gloss and low-temperature fusing ability of the toner.

The aliphatic diol (a) having 3 or 4 carbon atoms, the aliphatic diol having a hydroxyl group bound to a secondary carbon atom is exemplified by the above-mentioned diols. 1,2-Propanediol and 2,3-butanediol are preferred, and 1,2-propanediol is more preferred, from the viewpoint of improving gloss, low-temperature fusing ability, and heat-resistant storage property of the toner.

The content of the aliphatic diol (a) is preferably 35% by mol or more, more preferably 55% by mol or more, even more preferably 60% by mol or more, even more preferably 65% by mol or more, and even more preferably 70% by mol or more, of the alcohol component of the amorphous polyester (A), from the viewpoint of improving heat-resistant storage property of the toner. Also, the content of the aliphatic diol (a) is preferably 95% by mol or less, more preferably 93% by mol or less, even more preferably 90% by mol or less, and even more preferably 85% by mol or less, of the alcohol component of the amorphous polyester (A), from the viewpoint of improving gloss, high-temperature offset resistance, and low-temperature fusing ability of the toner.

The content of the aliphatic diol (a) is preferably from 35 to 95% by mol, more preferably from 35 to 93% by mol, even more preferably from 35 to 90% by mol, and even more preferably from 35 to 85% by mol, of the alcohol component of the amorphous polyester (A), from the viewpoint of improving gloss and high-temperature offset resistance of the toner.

The content of the aliphatic diol (a) is preferably from 35 to 95% by mol, more preferably from 55 to 95% by mol, even more preferably from 60 to 93% by mol, even more preferably from 65 to 90% by mol, even more preferably from 65 to 85% by mol, and even more preferably from 70 to 85% by mol, of the alcohol component of the amorphous polyester (A), from the viewpoint of improving gloss, high-temperature offset resistance, low-temperature fusing ability, and heat-resistant storage property of the toner.

Here, the content of the above-mentioned aliphatic diol (a) in a case where the amorphous resin contains amorphous polyester (A)'s in a plural number can be obtained by the sum of the products of a content of the aliphatic diol (a) in the alcohol component of each of the amorphous polyester (A)'s and a mass percentage of each of the amorphous polyester (A)'s.

When the amorphous resin contains an amorphous polyester other than the amorphous polyester (A), the content of the aliphatic diol (a) is preferably from 35 to 95% by mol, more preferably from 55 to 95% by mol, even more preferably from 60 to 93% by mol, even more preferably from 65 to 90% by mol, even more preferably from 65 to 85% by mol, and even more preferably from 70 to 85% by mol, of the alcohol component of all the amorphous polyesters contained in the amorphous resin, from the viewpoint of improving high-temperature offset resistance, gloss, low-temperature fusing ability, and heat-resistant storage property of the toner.

Here, the content of the aliphatic diol (a) of the alcohol component of all the amorphous polyesters can be obtained by the sum of the products of a content of the aliphatic diol (a) of the alcohol component of each of the amorphous polyesters and a mass percentage of each of the amorphous polyesters.

The aliphatic diol (b) containing one or more $\alpha,\omega$-linear alkanediols having 2, 4, 6 or 8 carbon atoms is exemplified by the above-mentioned diols. 1,4-Butanediol, 1,6-hexanediol, and 1,8-octanediol are preferred, and 1,4-butanediol is more preferred, from the viewpoint of improving high-temperature offset resistance, gloss, low-temperature fusing ability, and heat-resistant storage property of the toner.

The content of the aliphatic diol (b) is preferably 5% by mol or more, more preferably 7% by mol or more, even more preferably 10% by mol or more, and even more preferably 15% by mol or more, of the alcohol component of the amorphous polyester (A), from the viewpoint of improving gloss, high-temperature offset resistance, and low-temperature fusing ability of the toner. The content of the aliphatic diol (b) is preferably 65% by mol or less, more preferably 45% by mol or less, even more preferably 40% by mol or less, even more preferably 35% by mol or less, and even more preferably 30% by mol or less, of the alcohol component of the amorphous polyester (A), from the viewpoint of improving heat-resistance storage property of the toner.

The content of the aliphatic diol (b) is preferably from 5 to 65% by mol, more preferably from 7 to 65% by mol, even more preferably from 10 to 65% by mol, and even more preferably from 15 to 65% by mol, of the alcohol component of the amorphous polyester (A), from the viewpoint of improving gloss and high-temperature offset resistance of the toner.

The content of the aliphatic diol (b) is preferably from 5 to 65% by mol, more preferably from 5 to 45% by mol, even more preferably from 7 to 40% by mol, even more preferably from 10 to 35% by mol, even more preferably from 15 to 35% by mol, and even more preferably from 15 to 30% by mol, of the alcohol component of the amorphous polyester (A), from the viewpoint of improving high-temperature offset resistance, gloss, low-temperature fusing ability, and heat-resistant storage property of the toner.

Here, the content of the above-mentioned aliphatic diol (b) in a case where the amorphous resin contains amorphous polyester (A)'s in a plural number can be obtained by the sum of the products of a content of the aliphatic diol (b) in the alcohol component of each of the amorphous polyester (A)'s and a mass percentage of each of the amorphous polyester (A)'s.

When the amorphous resin contains an amorphous polyester other than the amorphous polyester (A), the content of the aliphatic diol (b) is preferably from 5 to 65% by mol, more preferably from 5 to 45% by mol, even more preferably from 7 to 40% by mol, even more preferably from 10 to 35% by mol, even more preferably from 15 to 35% by mol, and even more preferably from 15 to 30% by mol, of the alcohol component of all the amorphous polyesters contained in the amorphous resin, from the viewpoint of improving high-temperature offset resistance, gloss, low-temperature fusing ability, and heat-resistant storage property of the toner.

Here, the content of the aliphatic diol (b) of the alcohol component of all the amorphous polyesters can be obtained by the sum of the products of a content of the aliphatic diol (b) of the alcohol component of each of the amorphous polyesters and a mass percentage of each of the amorphous polyesters.

A total content of the aliphatic diol (a) and the aliphatic diol (b) in the alcohol component is preferably 80% by mol or more, more preferably 90% by mol or more, even more preferably 95% by mol or more, and even more preferably substantially 100% by mol, of the alcohol component of the amorphous polyester (A), from the viewpoint of improving high-temperature offset resistance, gloss, low-temperature fusing ability, and heat-resistant storage property of the toner.

A molar ratio of the aliphatic diol (a) to the aliphatic diol (b) in the alcohol component of the amorphous polyester (A), i.e. the aliphatic diol (a)/the aliphatic diol (b), is preferably from 95/5 to 35/65, more preferably from 93/7 to 35/65, even more preferably from 90/10 to 35/65, and even more preferably from 85/15 to 35/65, from the viewpoint of improving high-temperature offset resistance and gloss of the toner.

A molar ratio of the aliphatic diol (a) to the aliphatic diol (b) in the alcohol component of the amorphous polyester (A), i.e. the aliphatic diol (a)/the aliphatic diol (b), is preferably from 93/7 to 60/40, more preferably from 90/10 to 65/35, even more preferably from 85/15 to 65/35, and even more preferably from 85/15 to 70/30, from the viewpoint of improving high-temperature offset resistance, gloss, low-temperature fusing ability, and heat-resistant storage property of the toner.

When the amorphous resin contains an amorphous polyester other than the amorphous polyester (A), a molar ratio of the aliphatic diol (a) to the aliphatic diol (b) in the alcohol component of all the amorphous polyesters contained in the amorphous resin, i.e. the aliphatic diol (a)/the aliphatic diol (b), is preferably from 95/5 to 35/65, more preferably from 95/5 to 55/45, even more preferably from 93/7 to 60/40, even more preferably from 90/10 to 65/35, even more preferably from 85/15 to 65/35, and even more preferably from 85/15 to 70/30, from the viewpoint of improving high-temperature offset resistance, gloss, low-temperature fusing ability, and heat-resistant storage property of the toner.

The alcohol component other than the above includes dihydric alcohols such as diols having 3 to 20 carbon atoms, and preferably 3 to 15 carbon atoms; and an alkylene oxide adduct of bisphenol A represented by the formula (I); and the like.

The trihydric or higher polyhydric alcohol includes trihydric or higher polyhydric alcohols having 3 to 20 carbon atoms, and preferably 3 to 10 carbon atoms, and the like. Specific examples thereof include sorbitol, 1,4-sorbitan, pentaerythritol, glycerol, trimethylolpropane, and the like.

In Second Embodiment, the carboxylic acid component of the amorphous polyester (A) contains a dicarboxylic or higher polycarboxylic acid compound, from the viewpoint of improving high-temperature offset resistance, gloss, low-temperature fusing ability, and heat-resistant storage property of the toner.

The dicarboxylic acid compound includes, for example, dicarboxylic acids having 3 to 30 carbon atoms, preferably 3 to 20 carbon atoms, and more preferably 3 to 10 carbon atoms, and derivatives thereof such as acid anhydrides thereof, alkyl esters thereof of which alkyl group has 1 to 3 carbon atoms, and the like. Specific examples are preferably aromatic dicarboxylic acid compounds and aliphatic dicarboxylic acid compounds, and the aromatic dicarboxylic acid compounds are more preferred, from the viewpoint of improving low-temperature fusing ability and heat-resistant storage property of the toner. The aromatic dicarboxylic acid includes phthalic acid, isophthalic acid, terephthalic acid, and the like, among which terephthalic acid is preferred. The aliphatic dicarboxylic acid includes fumaric acid, maleic acid, succinic acid, glutaric acid, adipic acid, sebacic acid, succinic acid substituted with an alkyl group having 1 to 20 carbon atoms or an alkenyl group having 2 to 20 carbon atoms, among which fumaric acid is preferred, from the viewpoint of improving heat-resistant storage property of the toner.

The content of the dicarboxylic acid compound is preferably from 60 to 100% by mol, more preferably from 70 to 100% by mol, even more preferably from 80 to 100% by mol, and even more preferably from 85 to 100% by mol, of the carboxylic acid component of the amorphous polyester (A), from the viewpoint of improving high-temperature offset resistance, gloss, low-temperature fusing ability, and heat-resistant storage property of the toner.

Here, the content of the above-mentioned dicarboxylic acid compound in a case where the resin binder contains amorphous polyester (A)'s in a plural number can be obtained by the sum of the products of a content of the dicarboxylic acid compound in the carboxylic acid component of each of the amorphous polyester (A)'s and a mass percentage of each of the amorphous polyester (A)'s.

When the amorphous resin contains an amorphous polyester other than the amorphous polyester (A), the content of the dicarboxylic acid compound is preferably from 60 to 100% by mol, more preferably from 70 to 100% by mol, even more preferably from 80 to 100% by mol, and even more preferably from 85 to 100% by mol, of the carboxylic acid component of all the amorphous polyesters contained in the amorphous resin, from the viewpoint of improving high-temperature offset resistance, gloss, low-temperature fusing ability, and heat-resistant storage property of the toner.

Here, the content of the above-mentioned dicarboxylic acid compound in the carboxylic acid component of all the amorphous polyesters can be obtained by the sum of the products of a content of the dicarboxylic acid compound in the carboxylic acid component of each of the amorphous polyesters and a mass percentage of each of the amorphous polyesters.

The tricarboxylic or higher polycarboxylic acid compound includes, for example, tricarboxylic or higher polycarboxylic acids having 4 to 30 carbon atoms, preferably 4 to 20 carbon atoms, and more preferably 4 to 10 carbon atoms, derivatives thereof, such as acid anhydrides thereof and alkyl esters thereof of which alkyl group has 1 to 3 carbon atoms, and the like. Specific examples include 1,2,4-benzenetricarboxylic acid, i.e. trimellitic acid, 2,5,7-naphthalenetricarboxylic acid, 1,2,4,5-benzenetetracarboxylic acid, i.e. pyromellitic acid, and the like. 1,2,4-Benzenetricarboxylic acid, i.e. trimellitic acid, and an anhydride thereof are preferred, and 1,2,4-benzenetricarboxylic acid anhydride, i.e. trimellitic anhydride, is more preferred, from the viewpoint of improving low-temperature fusing ability, and heat-resistant storage property of the toner.

The content of the tricarboxylic or higher polycarboxylic acid compound is preferably 40% by mol or less, more preferably 30% by mol or less, even more preferably 20% by mol or less, and even more preferably 15% by mol or less, of the carboxylic acid component of the amorphous polyester (A), from the viewpoint of improving high-temperature offset resistance, gloss, low-temperature fusing ability, and heat-resistant storage property of the toner.

Also, the alcohol component may properly contain a monohydric alcohol, and the carboxylic acid component may properly contain a monocarboxylic acid compound, from the viewpoint of adjusting the softening point of the polyester.

An equivalent ratio, i.e. COOH group or groups/OH group or groups, of the carboxylic acid component and the alcohol component in the amorphous polyester (A) is preferably from 0.70 to 1.15, and more preferably from 0.75 to 1.10, from the viewpoint of reducing an acid value of the polyester.

The polycondensation reaction of the alcohol component and the carboxylic acid component, as mentioned above, can be carried out by polycondensing the components in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification catalyst is used in an amount of preferably from 0.01 to 1.5 parts by mass, and more preferably from 0.1 to 1.0 part by mass, based on 100 parts by mass of a total amount of the alcohol component and the carboxylic acid component. The esterification promoter includes gallic acid, and the like. The esterification promoter is used in an amount of preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The polymerization inhibitor is used in an amount of preferably from 0.001 to 0.5 parts by mass, and more preferably from 0.01 to 0.1 parts by mass, based on 100 parts by mass of a total amount of the alcohol component and the carboxylic acid component.

The amorphous polyester (A) has a softening point of preferably 80° C. or higher, more preferably 100° C. or higher, even more preferably 110° C. or higher, and even more preferably 120° C. or higher, from the viewpoint of improving high-temperature offset resistance and heat-resistant storage property of the toner. Also, the amorphous polyester (A) has a softening point of preferably 170° C. or lower, more preferably 160° C. or lower, even more preferably 150° C. or lower, and even more preferably 140° C. or lower, from the viewpoint of improving gloss and low-temperature fusing ability of the toner.

The softening point of the amorphous polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

The amorphous polyester (A) has a highest temperature of endothermic peak of preferably 50° C. or higher, from the viewpoint of improving high-temperature offset resistance and heat-resistant storage property of the toner. Moreover, the amorphous polyester has a highest temperature of endothermic peak of preferably 90° C. or lower, more preferably 85° C. or lower, and even more preferably 80° C. or lower, from the viewpoint of improving gloss and low-temperature fusing ability of the toner, and suppressing background fogging.

The highest temperature of endothermic peak of the amorphous polyester (A) can be controlled by the kinds, compositional ratios or the like of the alcohol component or the carboxylic acid component.

The amorphous polyester (A) has a glass transition temperature of preferably 50° C. or higher, from the viewpoint of improving high-temperature offset resistance and heat-resistant storage property of the toner. The amorphous polyester has a glass transition temperature of preferably 90° C. or lower, more preferably 85° C. or lower, and even more preferably 80° C. or lower, from the viewpoint of improving gloss and low-temperature fusing ability of the toner. Here, the glass transition temperature is a physical property intrinsically owned by an amorphous resin.

The glass transition temperature of the amorphous polyester (A) can be controlled by the kinds, compositional ratios and the like of the alcohol component or the carboxylic acid component.

The amorphous polyester (A) has an acid value of preferably 60 mgKOH/g or less, and more preferably 50 mgKOH/g or less, from the viewpoint of improving high-temperature offset resistance and heat-resistant storage property of the toner, and from the viewpoint of improving triboelectric chargeability of the toner, and suppressing background fogging.

The acid value of the amorphous polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

In Second Embodiment, two or more kinds of amorphous polyesters may be used as a resin binder, from the viewpoint of improving high-temperature offset resistance, gloss, low-temperature fusing ability, and heat-resistant storage property of the toner.

In Second Embodiment, as a crystalline resin, a crystalline polyester and a crystalline composite resin containing a polycondensation resin component and a styrenic resin component are preferred, and the crystalline polyester is more preferred, from the viewpoint of improving high-temperature offset resistance, gloss, low-temperature fusing ability, and heat-resistant storage property of the toner.

A content of the crystalline polyester or the crystalline composite resin, or a total content of the crystalline polyester and the crystalline composite resin, when containing both, is preferably 80% by mass or more, more preferably 90% by mass or more, even more preferably 95% by mass or more, and even more preferably substantially 100% by mass, of the crystalline resin, from the viewpoint of improving high-temperature offset resistance, gloss, low-temperature fusing ability, and heat-resistant storage property of the toner.

It is preferable that the alcohol component of the crystalline polyester contains an aliphatic diol having 2 to 10 carbon atoms, preferably 4 to 8 carbon atoms, and more preferably 4 to 6 carbon atoms, from the viewpoint of enhancing crystallinity.

The aliphatic diol having 2 to 10 carbon atoms includes ethylene glycol, 1,2-propylene glycol, 1,3-propylene glycol, 1,2-butanediol, 1,3-butanediol, 1,4-butanediol, 2,3-butanediol, 1,5-pentanediol, 1,6-hexanediol, 1,7-heptanediol, 1,8-octanediol, 1,9-nonanediol, neopentyl glycol, 1,4-butenediol, and the like. From the viewpoint of enhancing crystallinity of the resin, the aliphatic diol is preferably an α,ω-linear alkanediol having 2 to 10 carbon atoms, more preferably 1,4-butanediol and 1,6-hexanediol, and even more preferably 1,6-hexanediol.

The content of the aliphatic diol having 2 to 10 carbon atoms is preferably 70% by mol or more, more preferably from 80 to 100% by mol, even more preferably from 90 to 100% by mol, and even more preferably substantially 100% by mol, of the alcohol component, from the viewpoint of enhancing crystallinity of the resin. Further, a proportion of one kind of the aliphatic diols having 2 to 10 carbon atoms in the alcohol component is preferably 50% by mol or more, more preferably from 60 to 100% by mol, and even more preferably from 70 to 100% by mol.

The alcohol component other than the aliphatic diol having 2 to 10 carbon atoms includes aromatic diols such as an alkylene oxide adduct of bisphenol A represented by the above formula (I); trihydric or higher polyhydric alcohols such as glycerol, pentaerythritol, trimethylolpropane, sorbitol, and 1,4-sorbitan.

The carboxylic acid component of the crystalline polyester includes aliphatic dicarboxylic acid compounds, aromatic dicarboxylic acid compounds, tricarboxylic or higher polycarboxylic acid compounds, and the like.

The aliphatic dicarboxylic acid compounds are preferably aliphatic dicarboxylic acids having 2 to 20 carbon atoms, and include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid, acid anhydrides thereof, and alkyl esters thereof, the alkyl moiety of which has 1 to 3 carbon atoms, and the like. The aliphatic dicarboxylic acid compound refers to aliphatic dicarboxylic acids, acid anhydrides thereof, and alkyl esters thereof, the alkyl moiety of which has 1 to 3 carbon atoms, among which the aliphatic dicarboxylic acids are preferred. Moreover, fumaric acid is preferred, from the viewpoint of improving gloss and low-temperature fusing ability of the toner. Here, the number of carbon atoms of the alkyl moiety of the alkyl ester is not included in the number of carbon atoms of the aliphatic dicarboxylic acid compounds.

The aromatic dicarboxylic acid compound includes dicarboxylic acids such as phthalic acid, isophthalic acid, and terephthalic acid, acid anhydrides thereof, and alkyl esters thereof, the alkyl moiety of which has 1 to 3 carbon atoms. Phthalic acid, isophthalic acid, and terephthalic acid are preferred, and terephthalic acid is more preferred, from the viewpoint of improving high-temperature offset resistance and heat-resistant storage property of the toner.

The content of the aliphatic dicarboxylic acid compound and the aromatic dicarboxylic acid compound is preferably from 70 to 100% by mol, more preferably from 80 to 100% by mol, and even more preferably from 90 to 100% by mol, of the carboxylic acid component, from the viewpoint of improving gloss, high-temperature offset resistance, low-temperature fusing ability, and heat-resistant storage property of the toner.

The tricarboxylic or higher polycarboxylic acid compound includes, for example, tricarboxylic or higher polycarboxylic acids having 4 to 30 carbon atoms, preferably 4 to 20 carbon atoms, and more preferably 4 to 10 carbon atoms, and derivatives thereof such as acid anhydrides thereof, and alkyl esters, the alkyl moiety of which has 1 to 3 carbon atoms, and the like. Specific examples include 1,2,4-benzenetricarboxylic acid, i.e. trimellitic acid, 2,5,7-naphthalenetricarboxylic acid, 1,2,4,5-benzenetetracarboxylic acid, i.e. pyromellitic acid, and the like. 1,2,4-Benzenetricarboxylic acid, i.e. trimellitic acid, and an acid anhydride thereof are preferred, and 1,2,4-benzenetricarboxylic acid anhydride, i.e. trimellitic anhydride, is more preferred, from the viewpoint of improving low-temperature fusing ability and heat-resistant storage property of the toner.

The content of the tricarboxylic or higher polycarboxylic acid compound is preferably 10% by mol or less, of the carboxylic acid component, from the viewpoint of improving low-temperature fusing ability of the toner.

Other carboxylic acid compounds include a rosin, and a rosin modified with fumaric acid, maleic acid or acrylic acid, and the like.

The polycondensation reaction of the alcohol component and the carboxylic acid component of the crystalline polyester can be carried out in the same manner as that in the amorphous polyester.

On the other hand, in the crystalline composite resin containing a polycondensation resin component and a styrenic resin component, the raw material monomers for the polycondensation resin component include the same alcohol component and carboxylic acid component as those in the crystalline polyester. However, it is preferable that the carboxylic acid component of the polycondensation resin contains an aromatic dicarboxylic acid compound, from the viewpoint of enhancing crystallinity of the composite resin, and from the viewpoint of improving high-temperature offset resistance and heat-resistant storage property of the toner.

In other words, it is preferable that the crystalline composite resin is a composite resin containing a polycondensation resin component obtained by polycondensing an alcohol component containing an aliphatic diol having 2 to 10 carbon atoms and a carboxylic acid component containing an aromatic dicarboxylic acid compound, and a styrenic resin component.

The aromatic dicarboxylic acid compound includes the same aromatic dicarboxylic acid compounds as those in the crystalline polyester.

The content of the aromatic dicarboxylic acid compound is preferably from 70 to 100% by mol, more preferably from 90 to 100% by mol, and even more preferably substantially 100% by mol, of the carboxylic acid component, from the viewpoint of enhancing crystallinity of the composite resin, and from the viewpoint of improving high-temperature offset resistance and heat-resistance storage property of the toner.

Here, in the present specification, the dually reactive monomer described later is not included in the calculation of the contents of the alcohol component and the carboxylic acid component.

Of the total number of moles of the carboxylic acid component and the alcohol component, which are raw material monomers for the polycondensation resin component, a total number of moles of the aromatic dicarboxylic acid compound and the aliphatic diol having 2 to 10 carbon atoms is preferably from 75 to 100% by mol, more preferably from 85 to 100% by mol, even more preferably from 95 to 100% by mol, and even more preferably substantially 100% by mol, from the viewpoint of enhancing crystallinity of the composite resin, and from the viewpoint of improving gloss, high-temperature offset resistance, low-temperature fusing ability, and heat-resistant storage property of the toner.

The molar ratio of the carboxylic acid component to the alcohol component in the polycondensation resin component, i.e. the carboxylic acid component/the alcohol component, is such that the greater the proportion of the alcohol component the better, in order to achieve increased molecular weight in the composite resin, and the molar ratio is more preferably from 0.50 to 0.89, and even more preferably from 0.70 to 0.85.

The polycondensation reaction of the raw material monomers of the polycondensation resin component can be carried out in the same manner as that of the amorphous polyester.

As the raw material monomers for the styrenic resin component, styrene or styrene derivatives such as α-methylstyrene and vinyltoluene (hereinafter, the styrene and styrene derivatives are collectively referred to as "styrenic derivatives") are used.

The content of the styrenic derivative is preferably 70% by mass or more, more preferably 80% by mass or more, even more preferably 90% by mass or more, and even more preferably substantially 100% by mass, of the raw material monomers for a styrenic resin component, from the viewpoint of improving high-temperature offset resistance and heat-resistant storage property of the toner.

The raw material monomers for the styrenic resin component that are usable other than the styrenic derivative include alkyl(meth)acrylate ester such as 2-ethylhexyl(meth)acrylate and dimethylaminoethyl(meth)acrylate; ethylenically unsaturated monoolefins such as ethylene and propylene; diolefins such as butadiene; halovinyls such as vinyl chloride; vinyl esters such as vinyl acetate and vinyl propionate; vinyl ethers such as vinyl methyl ether; vinylidene halides such as vinylidene chloride; N-vinyl compounds such as N-vinylpyrrolidone; and the like.

The raw material monomers for the styrenic resin component that are usable other than the styrenic derivative can be used in a combination of two or more kinds. The term "(meth) acrylic acid" as used herein means acrylic acid and/or methacrylic acid.

Among the raw material monomers for the styrenic resin component that are usable other than the styrenic derivative, the alkyl(meth)acrylate ester is preferred, from the viewpoint of improving low-temperature fusing ability and gloss of the toner. The alkyl group in the alkyl(meth)acrylate ester has preferably 1 to 22 carbon atoms, and more preferably 8 to 18 carbon atoms, from the viewpoint mentioned above. Here, the number of carbon atoms of the alkyl ester refers to the number of carbon atoms originated from the alcohol component moiety constituting the ester.

The content of the alkyl(meth)acrylate ester is preferably 30% by mass or less, more preferably 20% by mass or less, and even more preferably 10% by mass or less, of the raw material monomers for the styrenic resin component, from the viewpoint of improving high-temperature offset resistance and heat-resistant storage property of the toner.

Here, a resin obtained by addition polymerization of raw material monomers containing a styrenic derivative and an alkyl(meth)acrylate ester is also referred to as styrene-(meth) acrylate resin.

The addition polymerization reaction of the raw material monomers for the styrenic resin component can be carried out by a conventional method, for example, a method of carrying out the reaction of the raw material monomers in the presence of a polymerization initiator such as dicumyl peroxide, a crosslinking agent, and the like in the presence of an organic solvent or in the absence of any solvents. The temperature conditions are preferably from 110° to 200° C., and more preferably from 140° to 170° C.

When an organic solvent is used upon the addition polymerization reaction, xylene, toluene, methyl ethyl ketone, acetone, or the like can be used. It is preferable that the organic solvent is used in an amount of from 10 to 50 parts by mass or so, based on 100 parts by mass of the raw material monomers for the styrenic resin component.

The styrenic resin component has a glass transition temperature Tg of preferably from 60° to 130° C., more preferably from 80° to 120° C., and even more preferably from 90° to 110° C., from the viewpoint of improving low-temperature fusing ability, gloss, high-temperature offset resistance, and heat-resistant storage property of the toner.

As to Tg of the styrenic resin component, a value obtained by a calculation based on Tgn of a homopolymer of each of the monomers constituting each polymer, in accordance with Fox formula (T. G. Fox, *Bull. Am. Physics Soc.,* 1(3), 123 (1956)), an empirical formula for predicting Tg by a thermal additive formula in a case of a polymer, is used as calculated from the following formula (I):

$$1/Tg=\Sigma(Wn/Tgn) \quad (1)$$

wherein Tgn is Tg expressed in absolute temperature for a homopolymer of each of the monomer components; and Wn is a mass percentage of each of the monomer components.

The dually reactive monomer described later as used herein is assumed not to be included in the calculation for the amount of the styrenic resin component contained, and not used in the calculation for Tg of the styrenic resin component.

In the calculation of the glass transition temperature Tg according to the Fox formula usable in Examples of the present invention, Tgn of styrene of 373K (100° C.) and Tgn of 2-ethylhexyl acrylate of 223K (−50° C.) are used.

It is preferable in the composite resin that the polycondensation resin component and the styrenic resin component are bonded directly or via a linking group. The linking group includes dually reactive monomers described later, compounds derived from chain transfer agents, and other resins, and the like.

The composite resin is preferably in a state that the polycondensation resin component and the styrenic resin component mentioned above are dispersed in each other, and the dispersion state mentioned above can be evaluated by a difference between Tg of the composite resin measured by the method described in Examples and a calculated value according to the above Fox formula.

The absolute value of a difference in a glass transition temperature of the composite resin and a glass transition temperature of the styrenic resin component of the composite resin calculated according to Fox formula is preferably 10° C. or more, more preferably 30° C. or more, even more preferably 50° C. or more, and even more preferably 70° C. or more. In general, since the polycondensation resin component has a Tg lower than Tg of the styrenic resin component, the found values for the Tg of the composite resin may be lower than calculated values of Tg of the styrenic resin in many cases.

The composite resin as described above can, for example, be obtained by (1) a method including the step of polycondensing raw material monomers for a polycondensation resin component in the presence of a styrenic resin having a carboxyl group or a hydroxyl group, wherein the carboxyl group or the hydroxyl group includes those derived from a dually reactive monomer or a chain transfer agent described later; and (2) a method including the step of subjecting raw material monomers for a styrenic resin component to addition polymerization in the presence of a polycondensation resin having a reactive unsaturated bond; or the like.

It is preferable that the composite resin is a resin obtained from the raw material monomers for the polycondensation resin component and the raw material monomers for the styrenic resin component, and further a dually reactive monomer, capable of reacting with both of the raw material monomers for the polycondensation resin component and the raw material monomers for the styrenic resin component, i.e. a hybrid resin, from the viewpoint of improving low-temperature fusing ability, gloss, high-temperature offset resistance, and heat-resistant storage property of the toner. Therefore, upon the polymerization of the raw material monomers for the polycondensation resin component and the raw material monomers for the styrenic resin component to obtain a composite resin, it is preferable that the polycondensation reaction and/or the addition polymerization reaction is carried out in the presence of the dually reactive monomer. By inclusion of the dually reactive monomer, the composite resin is a resin formed by binding the polycondensation resin component and the styrenic resin component via a constituting unit derived from the dually reactive monomer to form a hybrid resin, in which the polycondensation resin component and the styrenic resin component are more finely and homogeneously dispersed.

Specifically, it is preferable that the composite resin is a resin obtained by polymerizing (i) raw material monomers for a polycondensation resin component, containing an alcohol component containing an aliphatic diol having 2 to 10 carbon atoms and a carboxylic acid component containing an aromatic dicarboxylic acid compound; (ii) raw material monomers for a styrenic resin component; and (iii) a dually reactive monomer capable of reacting with both of the raw material monomers for the polycondensation resin component and the raw material monomers for the styrenic resin component.

It is preferable that the dually reactive monomer is a compound having in its molecule at least one functional group selected from the group consisting of a hydroxyl group, a carboxyl group, an epoxy group, a primary amino group and a secondary amino group, preferably a hydroxyl group and/or a carboxyl group, and more preferably a carboxyl group, and an ethylenically unsaturated bond. By using the dually reactive monomer described above, dispersibility of the resin forming a dispersion phase can be even more improved. Among them, acrylic acid and methacrylic acid are preferred, from the viewpoint of reactivity of the polycondensation reaction and the addition polymerization reaction.

The amount of the dually reactive monomer used is preferably from 1 to 30 mol, more preferably from 2 to 20 mol, and even more preferably 5 to 15 mol, based on 100 mol in a total of the alcohol component of the polycondensation resin component, and the amount of the dually reactive monomer used is preferably from 2 to 30 mol, and more preferably from 5 to 20 mol, based on 100 mol in a total of the raw material monomers for the styrenic resin component, not including a polymerization initiator, from the viewpoint of enhancing dispersibility between the styrenic resin component and the polycondensation resin component, and improving low-temperature fusing ability, gloss, high-temperature offset resistance, and heat-resistant storage property of the toner.

Specifically, it is preferable that a hybrid resin obtained by using a dually reactive monomer is produced by the following method. It is preferable that the dually reactive monomer is used in the addition polymerization reaction together with the raw material monomers for the styrenic resin component, from the viewpoint of improving low-temperature fusing ability, gloss, high-temperature offset resistance, and heat-resistant storage property of the toner.

(i) Method Including the Steps of (A) Carrying Out a Polycondensation Reaction of Raw Material Monomers for a Polycondensation Resin Component; and Thereafter (B) Carrying Out an Addition Polymerization Reaction of Raw Materials Monomers for a Styrenic Resin Component and a Dually Reactive Monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin component and the dually reactive monomer are added to a reaction system at a temperature appropriate for an addition polymerization reaction. The dually reactive monomer also reacts with the polycondensation resin component as well as in the addition polymerization reaction.

After the step (B), a reaction temperature is raised again, raw material monomers for a polycondensation resin component such as a trivalent or higher polyvalent monomer serving as a crosslinking agent is optionally added to the polymerization system, whereby the polycondensation reaction of the step (A) and the reaction with the dually reactive monomer can be further progressed.

(ii) Method Including the Steps of (B) Carrying Out an Addition Polymerization Reaction of Raw Material Monomers for a Styrenic Resin Component and a Dually Reactive Monomer, and Thereafter (A) Carrying Out a Polycondensation Reaction of Raw Material Monomers for a Polycondensation Resin Component In this method, the step (B) is carried out under reaction temperature conditions appropriate for an addition polymerization reaction, a reaction temperature is then raised, and the step (A) a polycondensation reaction is carried out under reaction temperature conditions appropriate for the polycondensation reaction. The dually reactive monomer is also involved in a polycondensation reaction as well as the addition polymerization reaction.

The raw material monomers for the polycondensation resin component may be present in a reaction system during the addition polymerization reaction, or the raw material monomers for the polycondensation resin component may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method Including the Steps of Concurrently Carrying Out the Step (A) a Polycondensation Reaction of Raw Material Monomers for a Polycondensation Resin Component; and the Step (B) an Addition Polymerization Reaction of Raw Materials Monomers for a Styrenic Resin Component and a Dually Reactive Monomer In this method, it is preferable that the steps (A) and (B) are carried out under reaction temperature conditions appropriate for an addition polymerization reaction, a reaction temperature is raised, an esterification catalyst, an esterification promoter, and raw material monomers for the polycondensation resin component of a trivalent or higher polyvalent monomer serving as a crosslinking agent are optionally added to a polymerization system, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also involved in a polycondensation reaction as well as the addition polymerization reaction.

In the above method (i), a polycondensation resin that is previously polymerized may be used in place of the step (A) carrying out a polycondensation reaction. In the above method (iii), when the steps (A) and (B) are concurrently carried out, a mixture containing raw material monomers for the styrenic resin component can be added dropwise to a mixture containing raw material monomers for the polycondensation resin component to react.

It is preferable that the above methods (i) to (iii) are carried out in a single vessel.

In the composite resin, a mass ratio of the polycondensation resin component to the styrenic resin component, i.e. the polycondensation resin component/the styrenic resin component (in the present invention, the mass ratio is defined as a mass ratio of the raw material monomers for the polycondensation resin component to the raw material monomers for the styrenic resin component), more specifically total mass of the raw material monomers for the polycondensation resin component/total mass of the raw material monomers for the styrenic resin component, is preferably from 50/50 to 95/5, more preferably from 60/40 to 95/5, and even more preferably from 70/30 to 90/10, from the viewpoint of improving low-temperature fusing ability, gloss, high-temperature offset resistance, and heat-resistant storage property of the toner, by having the polycondensation resin as a continuous phase and the styrenic resin as a dispersed phase. Here, in the above calculation, the amount of the dually reactive monomer is included in the raw material monomers for the polycondensation resin component. In addition, the amount of the polymerization initiator is not included in the amount of the raw material monomers for a styrenic resin component.

The crystalline resin has a softening point of preferably 80° C. or higher, more preferably 90° C. or higher, and even more preferably 100° C. or higher, from the viewpoint of improving high-temperature offset resistance and heat-resistant storage property of the toner. In addition, the crystalline resin has a softening point of preferably 160° C. or lower, more preferably 150° C. or lower, even more preferably 140° C. or lower, and even more preferably 130° C. or lower, from the viewpoint of improving low-temperature fusing ability and gloss of the toner.

In addition, the crystalline resin has a melting point, i.e. a highest temperature of endothermic peak, of preferably 80° C. or higher, and more preferably 100° C. or higher, from the viewpoint of improving high-temperature offset resistance and heat-resistant storage property of the toner. In addition, the crystalline resin has a melting point of preferably 150° C. or lower, more preferably 140° C. or lower, even more preferably 135° C. or lower, and even more preferably 130° C. or lower, from the viewpoint of improving low-temperature fusing ability and gloss of the toner.

The softening point and the melting point of the crystalline resin can be controlled by adjusting raw material monomer components, a polymerization initiator, a molecular weight, an amount of a catalyst, or the like, or selecting reaction conditions.

The content of the crystalline resin is preferably 45% by mass or less, more preferably 40% by mass or less, even more preferably 30% by mass or less, and even more preferably 25% by mass or less, of the resin binder, from the viewpoint of improving high-temperature offset resistance and heat-resistant storage property of the toner. Also, the content of the crystalline resin is preferably 5% by mass or more, more preferably 10% by mass or more, and even more preferably 15% by mass or more, of the resin binder, from the viewpoint of improving gloss and low-temperature fusing ability of the toner.

The content of the crystalline polyester or the crystalline composite resin, or when the crystalline resin contains both the crystalline polyester and the crystalline composite resin, the total content of the crystalline polyester and the crystalline composite resin is preferably 45% by mass or less, more preferably 40% by mass or less, even more preferably 30% by mass or less, and even more preferably 25% by mass or less, of the resin binder, from the viewpoint of improving high-temperature offset resistance and heat-resistant storage property of the toner. In addition, the above content is preferably 5% by mass or more, more preferably 10% by mass or more, and even more preferably 15% by mass or more, of the resin binder, from the viewpoint of improving gloss and low-temperature fusing ability of the toner.

In Second Embodiment, the mass ratio of the amorphous resin to the crystalline resin in the resin binder, i.e. the amorphous resin/the crystalline resin, is preferably from 55/45 to 95/5, more preferably from 60/40 to 90/10, even more preferably from 70/30 to 90/10, and even more preferably from 75/25 to 85/15, from the viewpoint of improving high-temperature offset resistance, gloss, low-temperature fusing ability, and heat-resistant storage property of the toner.

The mass ratio of the amorphous polyester (A) to the crystalline polyester or the crystalline composite resin, i.e. the amorphous polyester (A)/the crystalline polyester or the crystalline composite resin, in the resin binder is preferably from 55/45 to 95/5, more preferably from 60/40 to 90/10, even more preferably from 70/30 to 90/10, and even more preferably from 75/25 to 85/15, from the viewpoint of improving high-temperature offset resistance, gloss, low-temperature fusing ability, and heat-resistant storage property of the toner. In addition, when the crystalline resin contains the crystalline polyester and the crystalline composite resin, the mass ratio of the amorphous polyester (A) to a total amount of the crystalline polyester and the crystalline composite resin, i.e. the amorphous polyester (A)/a total amount of the crystalline polyester and the crystalline composite resin, in the resin binder is preferably from 55/45 to 95/5, more preferably from 60/40 to 90/10, even more preferably from 70/30 to 90/10, and even more preferably from 75/25 to 85/15, from the viewpoint of improving high-temperature offset resistance, gloss, low-temperature fusing ability, and heat-resistant storage property of the toner.

A total content of the amorphous resin and the crystalline resin in the resin binder is preferably 80% by mass or more, more preferably 90% by mass or more, even more preferably 95% by mass or more, and even more preferably substantially 100% by mass, from the viewpoint of improving high-temperature offset resistance, gloss, low-temperature fusing ability, and heat-resistant storage property of the toner.

A total content of the amorphous polyester (A) and the crystalline polyester or the crystalline composite resin is preferably 80% by mass or more, more preferably 90% by mass or more, even more preferably 95% by mass or more, and even more preferably substantially 100% by mass, of the resin binder, from the viewpoint of improving high-temperature offset resistance, gloss, low-temperature fusing ability, and heat-resistant storage property of the toner. In addition, when the crystalline resin contains the crystalline polyester and the crystalline composite resin, the total content of the amorphous polyester (A), the crystalline polyester, and the crystalline composite resin is preferably 80% by mass or more, more preferably 90% by mass or more, even more preferably 95% by mass or more, and even more preferably substantially 100% by mass, of the resin binder, from the viewpoint of improving high-temperature offset resistance, gloss, low-temperature fusing ability, and heat-resistant storage property of the toner.

[Wax]

As a wax, a wax having a melting point of from 60° to 120° C. is contained in an amount of from 0.2 to 13 parts by mass, based on 100 parts by mass of the resin binder.

The wax has a melting point of 60° C. or higher, preferably 65° C. or higher, more preferably 68° C. or higher, and even more preferably 70° C. or higher, from the viewpoint of improving low-temperature fusing ability, heat-resistant storage property, and high-temperature offset resistance of the toner. In addition, the wax has a melting point of 120° C. or lower, preferably 100° C. or lower, more preferably 90° C. or lower, even more preferably 85° C. or lower, and even more preferably 80° C. or lower, from the viewpoint of reducing mechanical force during melt-kneading, thereby suppressing heat generation, and from the viewpoint of improving low-temperature fusing ability, heat-resistant storage property, high-temperature offset resistance, gloss, and background fogging suppression of the toner. In addition, the wax has a melting point of from 60° to 120° C., preferably from 65° to 100° C., more preferably from 68° to 90° C., even more preferably from 70° to 85° C., and even more preferably from 70° to 80° C.

The wax may be any of those having melting points within the range mentioned above, and the wax includes aliphatic hydrocarbon waxes such as polypropylene wax, polyethylene wax, polypropylene polyethylene copolymer wax, microcrystalline wax, paraffin waxes, and Fischer-Tropsch wax, and oxides thereof; ester waxes such as synthetic ester waxes, carnauba wax, montan wax, sazole wax, and deacidified waxes thereof; fatty acid amides, fatty acids, higher alcohols, metal salts of aliphatic acids, and the like. These waxes may be used alone or in a mixture of two or more kinds. Among them, the aliphatic hydrocarbon waxes and the ester waxes are preferred, the paraffin waxes, the synthetic ester waxes, and the carnauba wax are more preferred, and the paraffin waxes and the synthetic ester waxes are even more preferred, from the viewpoint of improving low-temperature fusing ability, high-temperature offset resistance, and heat-resistant storage property of the toner. In addition, the ester waxes and aliphatic hydrocarbon waxes are preferred, the carnauba wax and the Fischer-Tropsch wax are more preferred, and the carnauba wax is even more preferred, from the viewpoint of improving high-temperature offset resistance, gloss, low-temperature fusing ability and heat-resistant storage property of the toner, and suppressing background fogging.

The content of the wax is 0.2 parts by mass or more, preferably 0.8 parts by mass or more, more preferably 1.0 part by mass or more, even more preferably 1.5 parts by mass or more, and even more preferably 2.0 parts by mass or more, based on 100 parts by mass of the resin binder, from the viewpoint of reducing mechanical forces during melt-kneading, thereby suppressing heat generation, and from the viewpoint of improving low-temperature fusing ability, heat-resistant storage property, high-temperature offset resistance, and gloss of the toner, and suppressing background fogging. Moreover, the content of wax is 13 parts by mass or less, preferably 10 parts by mass or less, more preferably 8.0 parts by mass or less, even more preferably 6.0 parts by mass or less, and even more preferably 4.0 parts by mass or less, based on 100 parts by mass of the resin binder, from the viewpoint of heat-resistant storage property and high-temperature offset resistance of the toner. In addition, the content of the wax is from 0.2 to 13 parts by mass, preferably from 0.8 to 10 parts by mass, more preferably from 1.0 to 8.0 parts by mass, even more preferably from 1.5 to 6.0 parts by mass, and even more preferably from 2.0 to 4.0 parts by mass, based on 100 parts by mass of the resin binder.

The wax may contain two or more kinds of waxes. When a plural waxes are contained, it is preferable that both a melting point of a wax having the lowest melting point and a melting point according to a weighted average of all the waxes are within the preferred range for the melting point of the wax mentioned above. The melting point according to a weighted average of all the waxes can be obtained by the sum of the products of the melting points of each of the waxes and the contained proportions.

In addition, as to the content, it is also preferable that the content of a wax having the lowest melting point and a total content of all the waxes are within the preferred range of the content of the wax mentioned above.

[Colorant]

In the present invention, as the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. As the colorant, Phthalocyanine Blue 15:3, Phthalocyanine Blue 15:4, and carbon blacks are preferred, and Phthalocyanine Blue 15:3 and carbon blacks are more preferred, from the viewpoint of improving low-temperature fusing ability and heat-resistant storage property of the toner.

The content of the colorant is preferably 1 part by mass or more, and more preferably 2 parts by mass or more, based on 100 parts by mass of the resin binder, from the viewpoint of improving optical density of the toner. In addition, the content of the colorant is preferably 20 parts by mass or less, more preferably 10 parts by mass or less, and even more preferably 5 parts by mass or less, based on 100 parts by mass of the resin binder, from the viewpoint of improving low-temperature fusing ability and heat-resistant storage property of the toner.

In the present invention, especially in First Embodiment, it is preferable to further use a charge control resin. Specifically, it is preferable that a mixture to be subjected to melt-kneading contains a charge control resin. By using the charge control resin, the toner obtained by the method of the present invention exhibits some excellent effects of having even more excellent gloss and background fogging suppression.

Although the reasons why the effects as described above are exhibited are not certain, they are presumably as follows.

The charge control resin serves to improve triboelectric stability of the toner, thereby suppressing background fogging; however, on the other hand, since the charge control resin is a resin, its compatibility with a resin binder is lowered, thereby lowering the gloss of the toner.

On the other hand, the components derived from the aliphatic diol (b) composed of the α,ω-linear alkanediols in the amorphous polyester (A) are more likely to take an orderly structure and thus more likely to be crystallized. However, the inclusion of components derived from aliphatic diol (a) having 3 or 4 carbon atoms, the aliphatic diol having a hydroxyl group bonded to a secondary carbon atom in particular amounts, allows to form an orderly structure to an extent that a melting point is not shown, so that viscosity is lowered during fusing, whereby gloss is improved even when a charge control resin is used.

The charge control resin includes styrene-acrylic resins, polyamine resins, phenolic resins, and the like. Among them, the styrene-acrylic resins are preferred, from the viewpoint of reducing a pulverization pressure during pulverization and suppressing the amount of fine powders generated, thereby improving the pulverization and classification yield.

The styrene-acrylic resin is preferably a styrene-acrylic copolymer containing a quaternary ammonium salt group, and more preferably a styrene-acrylic copolymer containing a quaternary ammonium salt group obtained by polymerizing a mixture of a monomer represented by the formula (II):

(II)

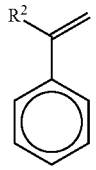

wherein $R^2$ is a hydrogen atom or a methyl group, a monomer represented by the formula (III):

(III)

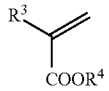

wherein $R^3$ is a hydrogen atom or a methyl group, and $R^4$ is an alkyl group having 1 to 6 carbon atoms, and a monomer represented by the formula (IV):

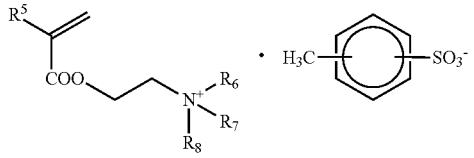

(IV)

wherein $R^5$ is a hydrogen atom or a methyl group, and each of $R^6$, $R^7$, and $R^8$ is an alkyl group having 1 to 4 carbon atoms.

In the formula (II), it is preferable that $R^2$ is a hydrogen atom, from the viewpoint of improving triboelectric chargeability of the toner.

In the formula (III), it is preferable that $R^3$ is a hydrogen atom, and that $R^4$ is a butyl group, from the viewpoint of improving triboelectric chargeability of the toner.

In the formula (IV), it is preferable that $R^5$ is a methyl group, and that each of $R^6$, $R^7$ and $R^8$ is an ethyl group, from the viewpoint of improving triboelectric chargeability of the toner.

The content of the monomer represented by the formula (II) is preferably from 60 to 95% by mass, more preferably from 70 to 95% by mass, and even more preferably from 78 to 90% by mass, of the monomer mixture, from the viewpoint of improving gloss of the toner and suppressing background fogging.

The content of the monomer represented by the formula (III) is preferably from 2 to 30% by mass, more preferably from 5 to 20% by mass, and even more preferably from 10 to 15% by mass, of the monomer mixture, from the viewpoint of improving gloss of the toner, and suppressing background fogging.

The content of the monomer represented by the formula (IV) is preferably from 3 to 35% by mass, more preferably from 5 to 30% by mass, and even more preferably from 10 to 25% by mass, of the monomer mixture, from the viewpoint of improving gloss of the toner, and suppressing background fogging.

The polymerization of the monomer mixture can be carried out by, for example, heating a monomer mixture to 50° to 100° C. in an inert gas atmosphere in the presence of a polymerization initiator such as azobisdimethylvaleronitrile. Here, the polymerization method may be any of solution polymerization, suspension polymerization, or bulk polymerization, and preferably solution polymerization.

The styrene-acrylic copolymer containing a quaternary ammonium salt group has a softening point of preferably 115° C. or higher, more preferably 117° C. or higher, and even more preferably 120° C. or higher, and a softening point of preferably 140° C. or lower, and more preferably 135° C. or lower, from the viewpoint of improving gloss, low-temperature fusing ability, heat-resistant storage property, and high-temperature offset resistance of the toner.

The styrene-acrylic copolymer containing a quaternary ammonium salt group includes, for example, "FCA-201PS" commercially available from FUJIKURA KASEI CO., LTD.

Other styrene-acrylic resins include "FCA-1001NS" commercially available from FUJIKURA KASEI CO., LTD., which is a styrene-acrylic copolymer not containing a quaternary ammonium salt group, and the like. In addition, the polyamine resin includes "AFP-B" commercially available from Orient Chemical Industries Co., Ltd., and the like, and the phenolic resin includes "FCA-2521NJ," "FCA-2508N," hereinabove commercially available from FUJIKURA KASEI CO., LTD.

The content of the charge control resin is preferably 1 part by mass or more, more preferably 3 parts by mass or more, even more preferably 4 parts by mass or more, and even more preferably 5 parts by mass or more, based on 100 parts by mass of the resin binder, from the viewpoint of improving triboelectric chargeability of the toner, and suppressing background fogging. The content of the charge control resin is preferably 10 parts by mass or less, more preferably 9 parts by mass or less, even more preferably 8 parts by mass or less, and even more preferably 7 parts by mass or less, based on 100 parts by mass of the resin binder, from the viewpoint of improving gloss and low-temperature fusing ability of the toner. Taking these viewpoints together, the content of the charge control resin is preferably from 1 to 10 parts by mass, more preferably from 3 to 9 parts by mass, even more preferably from 4 to 9 parts by mass, even more preferably from 4 to 8 parts by mass, and even more preferably from 5 to 7 parts by mass, based on 100 parts by mass of the resin binder.

The toner obtained by the method of the present invention may further contain a charge control agent and the like. It is preferable that the charge control agent is contained in the mixture to be subjected to melt-kneading.

[Charge Control Agent]

The charge control agent may be any of positively chargeable charge control agents and negatively chargeable charge control agents.

The negatively chargeable charge control agent includes metal-containing azo dyes, copper phthalocyanine dyes, metal complexes of alkyl derivatives of salicylic acid, nitroimidazole derivatives, boron complexes of benzilic acid, and the like. The metal-containing azo dyes include, for example, "VARIFAST BLACK 3804, "BONTRON S-28," "BONTRON S-31," "BONTRON S-32," "BONTRON S-34," "BONTRON S-36," hereinabove commercially available from Orient Chemical Industries Co., Ltd.; "T-77," "AIZEN SPILON BLACK TRH," hereinabove commercially available from Hodogaya Chemical Co., Ltd., and the like. The metal complexes of alkyl derivatives of salicylic acid include, for example, "BONTRON E-81," "BONTRON E-82," "BONTRON E-84," "BONTRON E-85," "BONTRON E-304," hereinabove commercially available from Orient Chemical Industries Co., Ltd., and the like. The boron complexes of benzilic acid include, for example, "LR-147" commercially available from Japan Carlit Co., Ltd., and the like.

The positively chargeable charge control agent includes Nigrosine dyes, triphenylmethane-based dyes, quaternary ammonium salt compounds, polyamine resins, imidazole derivatives, and the like. The Nigrosine dyes include, for example, "Nigrosine Base EX," "Oil Black BS," "Oil Black SO," "BONTRON N-01," "BONTRON N-07," "BONTRON N-09," "BONTRON N-11," hereinabove commercially available from Orient Chemical Industries Co., Ltd., and the like. The triphenylmethane-based dyes include, for example, triphenylmethane-based dyes containing a tertiary amine as a side chain. The quaternary ammonium salt compounds include, for example, "BONTRON P-51," "BONTRON P-52," hereinabove commercially available from Orient Chemical Industries Co., Ltd.; "TP-415" commercially available from Hodogaya Chemical Co., Ltd.; cetyltrimethylammonium bromide, "COPY CHARGE PX VP435," "COPY CHARGE PSY," hereinabove commercially available from Clariant Ltd., and the like. The polyamine resins include, for example, "AFP-B" commercially available from Orient Chemical Industries Co., Ltd., and the like. The imidazole derivatives include, for example, "PLZ-2001," "PLZ-8001," hereinabove commercially available from Shikoku Chemicals Corporation, and the like.

The content of the charge control agent is preferably 0.2 parts by mass or more, and more preferably 0.5 parts by mass or more, and the content is preferably 5 parts by mass or less, and more preferably 3 parts by mass or less, based on 100 parts by mass of the resin binder, from the viewpoint of improving triboelectric stability of the toner.

In the present invention, an additive such as a magnetic particulate, a fluidity improver, an electric conductivity modifier, a reinforcing filler such as a fibrous material, an antioxidant, an anti-aging agent, or a cleanability improver may be further properly contained as a toner material.

<Method for Producing Toner>

The toner of the present invention is produced by a method at least including the step of melt-kneading a mixture containing a resin binder and a wax.

The melt-kneading of a mixture containing a resin binder and a wax, and further optionally containing a colorant, a charge control resin, a charge control agent, or the like can be carried out with a known kneader, such as a closed kneader, a single-screw or twin-screw extruder, or an open-roller type kneader. From the viewpoint of lowering the temperature during melt-kneading, and improving low-temperature fusing ability, heat-resistant storage property, high-temperature offset resistance, and gloss of the toner, and from the viewpoint of being capable of efficiently highly dispersing the toner components such as a wax, a colorant, a charge control resin, and a charge control agent, in the resin binder without repeats of kneading or without a dispersion aid, it is preferable to use an open-roller type kneader, and the open-roller type kneader is more preferably provided with feeding ports and a discharging port for a kneaded product along the shaft direction of the roller.

It is preferable that the toner components, such as a resin binder, a wax, a colorant, a charge control resin, and a charge control agent, are previously mixed with a mixer such as a Henschel mixer or a ball-mill, and thereafter fed to a kneader.

When the mixture is fed to the open-roller type kneader, the mixture may be fed from one feeding port, or dividedly fed to the kneader from plural feeding ports. It is preferable that the mixture is fed to the kneader from one feeding port, from the viewpoint of easiness of operation and simplification of an apparatus.

The open-roller type kneader refers to a kneader of which kneading unit is an open type, not being tightly closed, and the kneading heat generated during the kneading can be easily dissipated. In addition, it is desired that the continuous open-roller type kneader is a kneader provided with at least two rollers. The continuous open-roller type kneader usable in the present invention is a kneader provided with two rollers having different peripheral speeds, in other words, two rollers of a high-rotation roller having a high peripheral speed and a low-rotation roller having a low peripheral speed. In the present invention, it is preferable that the high-rotation roller is a heat roller, and that the low-rotation roller is a cooling roller, from the viewpoint of improving dispersibility of the toner components such as a wax, a colorant, a charge control resin, and a charge control agent, in the resin binder, from the viewpoint of reducing mechanical forces during the melt-kneading, thereby suppressing heat generation, and from the viewpoint of improving low-temperature fusing ability, heat-resistant storage property, high-temperature offset resistance, and gloss of the toner, and suppressing background fogging.

The temperature of the roller can be adjusted by, for example, a temperature of a heating medium passing through the inner portion of the roller, and each roller may be divided in two or more portions in the inner portion of the roller, each being passed through with heating media of different temperatures.

The temperature at the end part of the component-supplying side of the high-rotation roller is preferably 100° C. or higher and 160° C. or lower, from the viewpoint of reducing mechanical forces during the melt-kneading, thereby suppressing heat generation, and from the viewpoint of improving low-temperature fusing ability, heat-resistant storage property, high-temperature offset resistance, and gloss of the toner, and suppressing background fogging, and the temperature at the end part of the component-supplying side of the low-rotation roller is preferably 30° C. or higher and 100° C. or lower, from the same viewpoint.

In the high-rotation roller, the difference between setting temperatures of the end part of the component-supplying side and the end part of the kneaded product-discharging side is preferably 20° C. or more, and more preferably 30° C. or more, from the viewpoint of preventing detachment of the kneaded product from the roller, from the viewpoint of reducing mechanical forces during the melt-kneading, thereby suppressing heat generation, and from the viewpoint of improving low-temperature fusing ability, heat-resistant storage property, high-temperature offset resistance, and gloss of the toner, and suppressing background fogging. Moreover, the difference in the setting temperatures is preferably 60° C. or less, and more preferably 50° C. or less, from the same viewpoint.

In the low-rotation roller, the difference between setting temperatures of the end part of the component-supplying side and the end part of the kneaded product-discharging side is preferably 0° C. or more, more preferably 10° C. or more, and even more preferably 20° C. or more, from the viewpoint of improving dispersibility of the toner components such as a wax, a colorant, a charge control resin, and a charge control agent, in the resin binder, from the viewpoint of reducing mechanical forces during the melt-kneading, thereby suppressing heat generation, and from the viewpoint of improving low-temperature fusing ability, heat-resistant storage property, high-temperature offset resistance, and gloss of the toner, and suppressing background fogging. The difference between setting temperatures is preferably 50° C. or less, from the same viewpoint.

The peripheral speed of the high-rotation roller is preferably 2 m/min or more, more preferably 10 m/min or more, and even more preferably 25 m/min or more, from the viewpoint of improving dispersibility of the toner components such as a wax, a colorant, a charge control resin, and a charge control agent, in the resin binder, from the viewpoint of reducing mechanical forces during the melt-kneading, thereby suppressing heat generation, and from the viewpoint of improving low-temperature fusing ability, heat-resistant storage property, high-temperature offset resistance, and gloss of the toner, and suppressing background fogging. Also, the peripheral speed of the high-rotation roller is preferably 100 m/min or less, more preferably 75 m/min or less, and even more preferably 50 m/min or less, from the same viewpoint.

The peripheral speed of the low-rotation roller is preferably 1 m/min or more, more preferably 5 m/min or more, and even more preferably 15 m/min or more, from the same viewpoint. Also, the peripheral speed of the low-rotation roller is preferably 90 m/min or less, more preferably 60 m/min or less, and even more preferably 30 m/min or less. In addition, the ratio of the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. From the viewpoint of increasing kneading share and improving dispersibility of the toner components such as a wax, a colorant, a charge control resin, and a charge control agent, in the resin binder, from the viewpoint of reducing mechanical forces during the melt-kneading, thereby suppressing heat generation, and from the viewpoint of improving low-temperature fusing ability, heat-resistant storage property, high-temperature offset resistance, and gloss of the toner, and suppressing background fogging, it is preferable that plural spiral ditches are engraved on the surface of each roller.

In the melt-kneading of the mixture, a twin-screw kneader may be used. The twin-screw kneader refers to a closed-type kneader in which two kneading screws are covered with barrel, and it is preferable that the twin-screw kneader is a type of which screws can be rotated in the same direction of the screw rotations. As commercially available products, twin-screw extruders, PCM Series commercially available from IKEGAI Corporation, which have excellent engagement of the two screws at high speeds, are preferred, from the viewpoint of improving productivity.

The melt-kneading with the twin-screw kneader is carried out by adjusting a barrel setting temperature, i.e. a temperature of an internal wall side of the kneader, peripheral speeds of the screw rotation of the twin screws, and supplying rates of raw materials. The barrel setting temperature is preferably 80° C. or higher, and more preferably 90° C. or higher, from the viewpoint of improving dispersibility of the toner components such as a wax, a colorant, a charge control resin, and a charge control agent, in the resin binder, from the viewpoint of reducing mechanical forces during the melt-kneading, thereby suppressing heat generation, from the viewpoint of improving low-temperature fusing ability, heat-resistant storage property, high-temperature offset resistance, and gloss of the toner, and suppressing background fogging, and from the viewpoint of improving productivity of the toner. Also, the barrel setting temperature is preferably 140° C. or lower, and more preferably 120° C. or lower, from the same viewpoint.

The peripheral speed of the screw rotation of the twin screws is preferably from 0.1 m/sec or more and 1 msec or less, from the viewpoint of improving dispersibility of a wax, a colorant, a charge control resin, a charge control agent and the like in the resin binder, from the viewpoint of reducing mechanical forces during the melt-kneading, thereby suppressing heat generation, from the viewpoint of improving low-temperature fusing ability, heat-resistant storage property, high-temperature offset resistance, and gloss of the toner, and suppressing background fogging, and from the viewpoint of improving productivity of the toner.

The feeding rates for the raw materials to the twin-screw kneader are appropriately adjusted in accordance with the allowable ability of the kneader used and the barrel setting temperature and the peripheral speed of the shaft rotations mentioned above.

It is preferable that the resulting resin kneaded mixture is cooled to a pulverizable state, and thereafter pulverized and classified.

The pulverizing step may be carried out in divided multistages. For example, the resin kneaded product may be roughly pulverized to a size of from 1 to 5 mm or so, and the roughly pulverized product may then be further finely pulverized to a desired particle size.

The pulverizer usable in the pulverizing step is not particularly limited. For example, the pulverizer preferably usable in the rough pulverization includes a hammer-mill, an atomizer, Rotoplex, and the like, and the pulverizer preferably usable in the fine pulverization includes an impact type jet mill, a fluidised bed opposed jet mill, a rotary mechanical mill, and the like. It is preferable to use a fluidised bed opposed jet mill and an impact type jet mill, and it is more preferable to use an impact type jet mill, from the viewpoint of pulverization efficiency.

The classifier used in the classification step includes an air classifier, a rotor type classifier, a sieve classifier, and the like. The pulverized product which is insufficiently pulverized and removed during the classifying step may be subjected to the pulverization step again, and the pulverization step and the classification step may be repeated as occasion demands.

In the method for producing a toner of the present invention, it is preferable that the method further includes, subsequent to the pulverizing and classifying step, the step of mixing the toner particles obtained, in other words, toner matrix particles, with an external additive, from the viewpoint of improving triboelectric chargeability, fluidity and transferability of the toner. Specific examples of the external additive include fine inorganic particles of silica, alumina, titania, zirconia, tin oxide, zinc oxide, and the like, and fine organic particles such as fine melamine resin particles and fine polytetrafluoroethylene resin particles. Two or more kinds of the external additives may be used in combination. Among them, silica is preferred, and a hydrophobic silica that is hydrophobically treated is more preferred, from the viewpoint of improving transferability of the toner.

The external additive has a number-average particle size of preferably 10 nm or more, more preferably 15 nm or more, and a number-average particle size of preferably 250 nm or less, more preferably 200 nm or less, and even more preferably 90 nm or less, from the viewpoint of improving triboelectric chargeability, fluidity, and transferability of the toner.

The content of the external additive is preferably 0.05 parts by mass or more, more preferably 0.1 parts by mass or more, and even more preferably 0.3 parts by mass or more, based on 100 parts by mass of the toner matrix particles before the treatment with the external additive, from the viewpoint of improving triboelectric chargeability, fluidity, and transferability of the toner. In addition, the content of the external additive is preferably 5 parts by mass or less, more preferably 4 parts by mass or less, and even more preferably 3 parts by mass or less, based on 100 parts by mass of the toner matrix particles before the treatment.

In the mixing of the toner matrix particles with an external additive, a mixer having an agitating member such as rotary blades is preferably used, more preferably a high-speed mixer such as a Henschel mixer or Super Mixer, and even more preferably a Henschel mixer.

The toner of the present invention has a volume-median particle size $D_{50}$ of preferably 3 μm or more, more preferably 4 μm or more, and even more preferably from 6 μm or more, from the viewpoint of improving the image quality of the toner. Also the toner has a volume-median particle size of preferably 15 μm or less, more preferably 12 μm or less, and even more preferably 9 μm or less. The term "volume-median particle size $D_{50}$" as used herein means a particle size of which cumulative volume frequency calculated on a volume percentage is 50% counted from the smaller particle sizes. Also, in a case where the toner is treated with an external additive, the volume-median particle size is regarded as a volume-median particle size of the toner matrix particles.

The toner obtained by the method of the present invention can be used as a toner directly for monocomponent development, or as a toner mixed with a carrier for two-component development, in an apparatus for forming fixed images of a monocomponent development or a two-component development.

Regarding the embodiments mentioned above, the present invention will further disclose the method for producing a toner for electrostatic image development and the toner for electrostatic image development as set forth below.

<1> A method for producing a toner for electrostatic image development including the step of melt-kneading a mixture containing a resin binder and a wax, wherein the resin binder contains an amorphous polyester (A) obtained by polycondensing an alcohol component containing an aliphatic diol (a) having 3 or 4 carbon atoms, the aliphatic diol having a hydroxyl group bonded to a secondary carbon atom, and an aliphatic diol (b) containing one or more α,ω-linear alkanediols having 2, 4, 6 or 8 carbon atoms, and a carboxylic acid component, a molar ratio of the aliphatic diol (a) to the aliphatic diol (b), i.e. aliphatic diol (a)/aliphatic diol (b), being from 95/5 to 55/45, and wherein the wax has a melting point of from 60° to 120° C., and a content of the wax being from 0.2 to 13 parts by mass, based on 100 parts by mass of the resin binder.

<2> The method according to the above <1>, wherein the content of the amorphous polyester (A) is preferably 80% by mass or more, more preferably 90% by mass or more, and even more preferably 95% by mass or more, of the resin binder.

<3> The method according to the above <1> or <2>, wherein the aliphatic diol (a) is at least one member selected from the group consisting of 1,2-propanediol, 1,2-butanediol, 1,3-butanediol, and 2,3-butanediol, preferably 1,2-propanediol and 2,3-butanediol, and more preferably 1,2-propanediol.

<4> The method according to any one of the above <1> to <3>, wherein the content of the aliphatic diol (a) of the alcohol component of the amorphous polyester (A) is preferably 35% by mol or more, more preferably 55% by mol or more, even more preferably 60% by mol or more, even more preferably 65% by mol or more, and even more preferably 70% by mol or more, and preferably 95% by mol or less, more preferably 93% by mol or less, even more preferably 90% by mol or less, even more preferably 85% by mol or less, and even more preferably 75% by mol or less, and preferably from 35 to 95% by mol, more preferably from 55 to 95% by mol, even more preferably from 60 to 93% by mol, even more preferably from 65 to 90% by mol, even more preferably from 65 to 85% by mol, even more preferably from 70 to 85% by mol, and even more preferably from 70 to 75% by mol.

<5> The method according to any one of the above <1> to <4>, wherein when the resin binder contains a polyester other than the amorphous polyester (A), the content of the aliphatic diol (a) is preferably from 35 to 95% by mol, more preferably from 55 to 95% by mol, even more preferably from 60 to 93% by mol, even more preferably from 65 to 90% by mol, even more preferably from 65 to 85% by mol, even more preferably from 70 to 85% by mol, and even more preferably from 70 to 75% by mol, of the alcohol component of all the polyesters contained in the resin binder.

<6> The method according to any one of the above <1> to <5>, wherein the aliphatic diol (b) is preferably at least one member selected from the group consisting of 1,4-butanediol, 1,6-hexanediol, and 1,8-octanediol, and more preferably 1,4-butanediol.

<7> The method according to any one of the above <1> to <6>, wherein the content of the aliphatic diol (b), of the alcohol component of the amorphous polyester (A), is preferably 5% by mol or more, more preferably 7% by mol or more, even more preferably 10% by mol or more, and even more preferably 15% by mol or more, and preferably 65% by mol or less, more preferably 45% by mol or less, even more preferably 40% by mol or less, even more preferably 35% by mol or less, and even more preferably 30% by mol or less, and preferably from 5 to 65% by mol, more preferably from 5 to 45% by mol, even more preferably from 7 to 40% by mol, even more preferably from 10 to 35% by mol, even more preferably from 15 to 35% by mol, even more preferably from 15 to 30% by mol, and even more preferably from 25 to 30% by mol.

<8> The method according to any one of the above <1> to <7>, wherein when the resin binder contains a polyester other than the amorphous polyester (A), the content of the aliphatic diol (b) is preferably from 5 to 65% by mol, more preferably from 5 to 45% by mol, even more preferably from 7 to 40% by mol, even more preferably from 10 to 35% by mol, even more preferably from 15 to 35% by mol, even more preferably from 15 to 30% by mol, and even more preferably from 25 to 30% by mol, of the alcohol component of all the polyesters contained in the resin binder.

<9> The method according to any one of the above <1> to <8>, wherein a total content of the aliphatic diol (a) and the aliphatic diol (b) in the alcohol component is preferably 80% by mol or more, more preferably 90% by mol or more, even more preferably 95% by mol or more, and even more preferably substantially 100% by mol, of the alcohol component of the amorphous polyester (A).

<10> The method according to any one of the above <1> to <9>, wherein a molar ratio of the aliphatic diol (a) to the aliphatic diol (b) in the alcohol component of the amorphous polyester (A), i.e. the aliphatic diol (a)/aliphatic diol (b), is preferably from 93/7 to 55/45, more preferably from 85/15 to 55/45, and even more preferably from 75/25 to 55/45.

<11> The method according to any one of the above <1> to <10>, wherein a molar ratio of the aliphatic diol (a) to the aliphatic diol (b) in the alcohol component of the amorphous polyester (A), i.e. the aliphatic diol (a)/aliphatic diol (b), is preferably from 93/7 to 60/40, more preferably from 90/10 to 65/35, even more preferably from 85/15 to 65/35, even more preferably from 85/15 to 70/30, and even more preferably from 75/25 to 70/30.

<12> The method according to any one of the above <1> to <11>, wherein when the resin binder contains a polyester other than the amorphous polyester (A), the molar ratio of the aliphatic diol (a) to the aliphatic diol (b) in the alcohol component of all the polyesters, i.e. the aliphatic diol (a)/aliphatic diol (b), is preferably from 93/7 to 60/40, more preferably from 90/10 to 65/35, even more preferably from 85/15 to 65/35, even more preferably from 85/15 to 70/30, and even more preferably from 75/25 to 70/30.

<13> The method according to any one of the above <1> to <12>, wherein the carboxylic acid component of the amorphous polyester (A) contains a dicarboxylic or higher polycarboxylic acid compound.

<14> The method according to the above <13>, wherein the content of the dicarboxylic acid compound is preferably from 60 to 100% by mol, more preferably from 70 to 100% by mol, even more preferably from 80 to 100% by mol, and even more preferably from 85 to 100% by mol, of the carboxylic acid component of the amorphous polyester (A).

<15> The method according to any one of the above <1> to <14>, wherein the carboxylic acid component of the amorphous polyester (A) contains a tricarboxylic or higher polycarboxylic acid compound, and wherein the tricarboxylic or higher polycarboxylic acid compound is preferably 1,2,4-benzenetricarboxylic acid, i.e. trimellitic acid, and/or an acid anhydride thereof, and more preferably 1,2,4-benzenetricarboxylic acid anhydride, i.e. trimellitic anhydride.

<16> The method according to the above <15>, wherein the content of the tricarboxylic or higher polycarboxylic acid compound is preferably 40% by mol or less, more preferably 30% by mol or less, even more preferably 20% by mol or less, and even more preferably 15% by mol or less, of the carboxylic acid component.

<17> The method according to any one of the above <1> to <16>, wherein The amorphous polyester (A) has a softening point of preferably 80° C. or higher, more preferably 100° C. or higher, even more preferably 110° C. or higher, and even more preferably 120° C. or higher, and preferably 170° C. or lower, more preferably 160° C. or lower, even more preferably 150° C. or lower, even more preferably 145° C. or lower, and even more preferably 140° C. or lower.

<18> The method according to any one of the above <1> to <17>, wherein the amorphous polyester (A) has a highest temperature of endothermic peak of preferably 50° C. or higher, and preferably 90° C. or lower, more preferably 85° C. or lower, and even more preferably 80° C. or lower.

<19> The method according to any one of the above <1> to <18>, wherein The amorphous polyester (A) has a glass transition temperature of preferably 50° C. or higher, more preferably 60° C. or higher, and even more preferably 65° C. or higher, and preferably 90° C. or lower, more preferably 85° C. or lower, and even more preferably 80° C. or lower.

<20> The method according to any one of the above <1> to <19>, wherein the amorphous polyester (A) alone is used as a resin binder.

<21> The method according to any one of the above <1> to <19>, wherein the resin binder contains a crystalline resin and an amorphous resin, wherein the amorphous resin contains the amorphous polyester (A).

<22> The method according to the above <21>, wherein the content of the amorphous polyester (A) is preferably 80% by mass or more, more preferably 90% by mass or more, even more preferably 95% by mass or more, of the amorphous resin, and even more preferably the amorphous polyester (A) alone being used as the amorphous resin.

<23> The method according to the above <21> or <22>, wherein the content of the amorphous polyester (A) is preferably 55% by mass or more, more preferably 60% by mass or more, even more preferably 70% by mass or more, and even more preferably 75% by mass or more, and the content of the amorphous polyester (A) is preferably 95% by mass or less, more preferably 90% by mass or less, and even more preferably 85% by mass or less, of the resin binder.

<24> The method according to any one of the above <21> to <23>, wherein when the amorphous resin contains an amorphous polyester other than the amorphous polyester (A), the content of the aliphatic diol (a) is preferably from 35 to 95% by mol, more preferably from 55 to 95% by mol, even more preferably from 60 to 93% by mol, even more preferably from 65 to 90% by mol, even more preferably from 65 to 85% by mol, and even more preferably from 70 to 85% by mol, of the alcohol component of all the amorphous polyesters contained in the amorphous resin.

<25> The method according to any one of the above <21> to <24>, wherein when the amorphous resin contains an amorphous polyester other than the amorphous polyester (A), the content of the aliphatic diol (b) is preferably from 5 to 65% by mol, more preferably from 5 to 45% by mol, even more preferably from 7 to 40% by mol, even more preferably from 10 to 35% by mol, even more preferably from 15 to 35% by mol, and even more preferably from 15 to 30% by mol, of the alcohol component of all the amorphous polyesters contained in the amorphous resin.

<26> The method according to any one of the above <21> to <25>, wherein when the amorphous resin contains an amorphous polyester other than the amorphous polyester (A), a molar ratio of the aliphatic diol (a) to the aliphatic diol (b) in the alcohol component of all the amorphous polyesters contained in the amorphous resin, i.e. the aliphatic diol (a)/the aliphatic diol (b), is preferably from 95/5 to 35/65, more preferably from 95/5 to 55/45, even more preferably from 93/7 to 60/40, even more preferably from 90/10 to 65/35, even more preferably from 85/15 to 65/35, and even more preferably from 85/15 to 70/30.

<27> The method according to any one of the above <21> to <26>, wherein the crystalline resin contains a crystalline polyester and/or a crystalline composite resin containing a polycondensation resin component and a styrenic resin component.

<28> The method according to the above <27>, wherein it is preferable that the alcohol component of the crystalline polyester contains an aliphatic diol having 2 to 10 carbon atoms, preferably 4 to 8 carbon atoms, and more preferably 4 to 6 carbon atoms, and wherein the aliphatic diol having 2 to 10 carbon atoms is preferably an α,ω-linear alkanediol having 2 to 10 carbon atoms, more preferably 1,4-butanediol and 1,6-hexanediol, and even more preferably 1,6-hexanediol.

<29> The method according to the above <28>, wherein the content of the aliphatic diol having 2 to 10 carbon atoms is preferably 70% by mol or more, more preferably from 80 to 100% by mol, even more preferably from 90 to 100% by mol, and even more preferably substantially 100% by mol, of the alcohol component, and wherein a proportion of one kind of the aliphatic diols having 2 to 10 carbon atoms in the alcohol component is preferably 50% by mol or more, more preferably from 60 to 100% by mol, and even more preferably from 70 to 100% by mol.

<30> The method according to any one of the above <27> to <29>, wherein the crystalline composite resin is a composite resin containing a polycondensation resin component obtained by polycondensing an alcohol component containing an aliphatic diol having 2 to 10 carbon atoms and a carboxylic acid component containing an aromatic dicarboxylic acid compound, and a styrenic resin component.

<31> The method according to any one of the above <27> to <30>, wherein the composite resin is a resin obtained by polymerizing (i) raw material monomers for a polycondensation resin component, containing an alcohol component containing an aliphatic diol having 2 to 10 carbon atoms and a carboxylic acid component containing an aromatic dicarboxylic acid compound; (ii) raw material monomers for a styrenic resin component; and (iii) a dually reactive monomer capable of reacting with both of the raw material monomers for the polycondensation resin component and the raw material monomers for the styrenic resin component.

<32> The method according to any one of the above <27> to <31>, wherein a mass ratio of the polycondensation resin component to the styrenic resin component, i.e. polycondensation resin component/styrenic resin component, (in the present invention, the mass ratio is defined as a mass ratio of the raw material monomers for the polycondensation resin component to the raw material monomers for the styrenic resin component), more specifically total mass of the raw material monomers for the polycondensation resin component/total mass of the raw material monomers for the styrenic resin component, is preferably from 50/50 to 95/5, more preferably from 60/40 to 95/5, and even more preferably from 70/30 to 90/10.

<33> The method according to any one of the above <21> to <32>, wherein the content of the crystalline resin in the resin binder is preferably 45% by mass or less, more preferably 40% by mass or less, even more preferably 30% by mass or less, and even more preferably 25% by mass or less, and preferably 5% by mass or more, more preferably 10% by mass or more, and even more preferably 15% by mass or more.

<34> The method according to any one of the above <21> to <33>, wherein the mass ratio of the amorphous resin to the crystalline resin in the resin binder, i.e. the amorphous resin/the crystalline resin, is preferably from 55/45 to 95/5, more preferably from 60/40 to 90/10, even more preferably from 70/30 to 90/10, and even more preferably from 75/25 to 85/15.

<35> The method according to any one of the above <1> to <34>, wherein the wax has a melting point of preferably 65° C. or higher, more preferably 68° C. or higher, and even more preferably 70° C. or higher, and preferably 100° C. or lower, more preferably 90° C. or lower, even more preferably 85° C. or lower, and even more preferably 80° C. or lower, and preferably from 65° to 100° C., more preferably from 68° to 90° C., even more preferably from 70° to 85° C., and even more preferably from 70° to 80° C.

<36> The method according to any one of the above <1> to <35>, wherein the wax is preferably an aliphatic hydrocarbon wax and/or an ester wax, more preferably at least one member selected from the group consisting of paraffin waxes, the synthetic ester waxes, and the carnauba wax, and even more preferably a paraffin wax and/or a synthetic ester wax.

<37> The method according to. any one of the above <1> to <35>, wherein the wax is preferably an ester wax and/or an aliphatic hydrocarbon wax, more preferably carnauba wax and/or Fischer-Tropsch wax, and even more preferably carnauba wax.

<38> The method according to any one of the above <1> to <37>, wherein the content of the wax is preferably 0.8 parts by mass or more, more preferably 1.0 part by mass or more, even more preferably 1.5 parts by mass or more, and even more preferably 2.0 parts by mass or more, and preferably 10 parts by mass or less, more preferably 8.0 parts by mass or less, even more preferably 6.0 parts by mass or less, and even more preferably 4.0 parts by mass or less, preferably from 0.8 to 10 parts by mass, more preferably from 1.0 to 8.0 parts by mass, even more preferably from 1.5 to 6.0 parts by mass, and even more preferably from 2.0 to 4.0 parts by mass, based on 100 parts by mass of the resin binder.

<39> The method according to any one of the above <1> to <38>, wherein a mixture to be subjected to melt-kneading contains a charge control resin.

<40> The method according to the above <39>, wherein the charge control resin is preferably a styrene-acrylic resin, and wherein the styrene-acrylic resin is preferably a styrene-acrylic copolymer containing a quaternary ammonium salt group, and more preferably a styrene-acrylic copolymer containing a quaternary ammonium salt group obtained by polymerizing a mixture of a monomer represented by the formula (II), a monomer represented by the formula (III), and a monomer represented by the formula (IV).

<41> The method according to any one of the above <39> or <40>, wherein the content of the charge control resin is preferably 1 part by mass or more, more preferably 3 parts by mass or more, even more preferably 4 parts by mass or more, even more preferably 5 parts by mass or more, and preferably 10 parts by mass or less, more preferably 9 parts by mass or less, even more preferably 8 parts by mass or less, and even more preferably 7 parts by mass or less, and preferably from 1 to 10 parts by mass, more preferably from 3 to 9 parts by mass, even more preferably from 4 to 9 parts by mass, even more preferably from 4 to 8 parts by mass, and even more preferably from 5 to 7 parts by mass, based on 100 parts by mass of the resin binder.

<42> The method according to any one of the above <39> to <41>, wherein the mixture to be subjected to melt-kneading further contains a charge control agent.

<43> The method according to the above <42>, wherein the content of the charge control agent is preferably 0.2 parts by mass or more, more preferably 0.5 parts by mass or more, and preferably 5 parts by mass or less, and more preferably 3 parts by mass or less, based on 100 parts by mass of the resin binder.

<44> Use of a composition obtained by a method including the step of melt-kneading a mixture containing a resin binder and a wax, wherein the resin binder contains an amorphous polyester (A) obtained by polycondensing an alcohol component containing an aliphatic diol (a) having 3 or 4 carbon atoms, the aliphatic diol having a hydroxyl group bonded to a secondary carbon atom, and an aliphatic diol (b) containing one or more α,ω-linear alkanediols having 2, 4, 6 or 8 carbon atoms, and a carboxylic acid component, a molar ratio of the aliphatic diol (a) to the aliphatic diol (b), i.e. aliphatic diol (a)/aliphatic diol (b), being from 95/5 to 55/45, and wherein the wax has a melting point of from 60° to 120° C., and a content of the wax being from 0.2 to 13 parts by mass, based on 100 parts by mass of the resin binder, as a toner for electrostatic image development in an apparatus for forming fixed images according to a monocomponent development method or a two-component development method.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester, commercially available from Shimadzu Corporation, CAPILLARY RHEOMETER "CFT-500D", against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Highest Temperature of Endothermic Peak of Resin]

Measurements are taken using a differential scanning calorimeter "Q-100," commercially available from TA Instruments, Japan, by weighing out a 0.01 to 0.02 g sample in an aluminum pan, cooling the sample from room temperature to 0° C. at a cooling rate of 10° C./min, and keeping at 0° C. for one minute. Thereafter, the measurements are taken while heating at a rate of 50° C./min. Of the endothermic peaks observed, a temperature of the peak of the highest temperature side is defined as a highest temperature of endothermic peak. When a difference between a highest temperature of endothermic peak and a softening point is within 20° C., the highest temperature is defined as a melting point.

[Glass Transition Temperature of Amorphous Resin]

Measurements are taken using a differential scanning calorimeter "Q-100," commercially available from TA Instruments, Japan, by weighing out a 0.01 to 0.02 g sample in an aluminum pan, heating the sample to 200° C., and cooling the sample from that temperature to 0° C. at a cooling rate of 10° C./min. Next, the measurements are taken while heating at a rate of 10° C./min. A temperature of an intersection of the extension of the baseline of equal to or lower than the highest temperature of endothermic peak and the tangential line showing the maximum inclination between the kick-off of the peak and the top of the peak in the above measurement is defined as a glass transition temperature.

[Glass Transition Temperature of Crystalline Resin]

Measurements are taken using a differential scanning calorimeter "Q-100," commercially available from TA Instruments, Japan, by weighing out a 0.01 to 0.02 g sample in an aluminum pan, heating the sample to 200° C., and cooling the sample from that temperature to −80° C. at a cooling rate of 100° C./min. Next, the glass transition temperature is measured by heating the sample at a heating rate of 10° C./min in a modulated mode. A temperature of an intersection of the extension of the baseline of equal to or lower than the highest temperature of endothermic peak and the tangential line showing the maximum inclination between the kick-off of the peak and the top of the peak in the above measurement is defined as a glass transition temperature.

[Acid Value of Resin]

The acid value is determined by a method according to JIS K0070 except that only the determination solvent is changed from a mixed solvent of ethanol and ether as defined in JIS K0070 to a mixed solvent of acetone and toluene in a volume ratio of acetone:toluene=1:1.

[Melting Point of Wax]

Measurements are taken using a differential scanning calorimeter "DSC Q20," commercially available from TA Instruments, Japan, by weighing out a 0.01 to 0.02 g sample in an aluminum pan, heating the sample to 200° C. at a heating rate of 10° C./min, and cooling the sample from that temperature to −10° C. at a cooling rate of 5° C./min. Next, the measurements are taken while heating the sample at a rate of 10° C./min to 180° C. A highest temperature of endothermic peak observed in the melting endothermic curve in the above measurements obtained is defined as a melting point of a wax.

[Number-Average Particle Size of External Additive]

Particle sizes were determined for 500 particles from a photograph taken with a scanning electron microscope (SEM), an average of length and breadth of the particles of which is taken, and the average is referred to as a number-average particle size.

[Volume-Median Particle Size $D_{50}$ of Toner]

Measuring Apparatus Coulter Multisizer II, commercially available from Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6, is dissolved in the above electrolytic solution so as to have a concentration of 5% by mass to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

Production Example A-1 of Resins

Resins A to H, Resins J to L, and Resins N to W

A 5-liter four-neck flask equipped with a nitrogen inlet tube, a dehydration tube, a stirrer, and a thermocouple was charged with raw material monomers other than trimellitic anhydride and an esterification catalyst, as listed in Tables A-1 to A-3. The temperature was raised to 200° C. in a nitrogen atmosphere, and the components were reacted at that temperature for 6 hours. Further, the temperature was raised to 210° C., trimellitic anhydride was then added to the reaction mixture, and the components were reacted at an ambient pressure, 101.3 kPa, for 1 hour, and further reacted at 40 kPa until a desired softening point was reached. The physical properties of the resins obtained are shown in Tables A-1 to A-3.

Production Example of Resin A-2

Resin I

A 5-liter four-neck flask equipped with a nitrogen inlet tube, a dehydration tube, a stirrer, and a thermocouple was charged with raw material monomers and an esterification catalyst as listed in Table A-1. The temperature was raised to 200° C. in a nitrogen atmosphere, and the components were reacted at that temperature for 6 hours. Further, the temperature was raised to 210° C., and the components were reacted at an ambient pressure, 101.3 kPa, for 1 hour, and further reacted at 40 kPa until a softening point reached 130° C. The physical properties of the resins obtained are shown in Table A-1.

Production Example of Resin A-3

Resin M

A 5-liter four-neck flask equipped with a nitrogen inlet tube, a dehydration tube, a stirrer, and a thermocouple was charged with raw material monomers other than trimellitic anhydride, an esterification catalyst, and a polymerization inhibitor as listed in Table A-2. The temperature was raised to 200° C. in a nitrogen atmosphere, and the components were reacted at that temperature for 6 hours. Further, the temperature was raised to 210° C., trimellitic anhydride was then added to the reaction mixture, and the components were reacted at an ambient pressure, 101.3 kPa, for 1 hour, and further reacted at 40 kPa until a softening point reached 131° C. The physical properties of the resin obtained are shown in Table A-2.

TABLE A-1

| | | Resin A | Resin B | Resin C | Resin D | Resin E | Resin F | Resin G | Resin H | Resin I | Resin J | Resin K |
|---|---|---|---|---|---|---|---|---|---|---|---|---|
| Raw Material Monomers Alcohol Component | | | | | | | | | | | | |
| Aliphatic Diol (a) | 1,2-Propanediol | 913 g (60) | 1065 g (70) | 1217 g (80) | 1370 g (90) | 1446 g (95) | 1522 g (100) | 761 g (50) | 609 g (40) | 1065 g (70) | 1065 g (70) | 1065 g (70) |
| Aliphatic Diol (b) | 1,4-Butanediol | 721 g (40) | 541 g (30) | 360 g (20) | 180 g (10) | 90 g (5) | — | 901 g (50) | 1081 g (60) | 541 g (30) | 541 g (30) | 541 g (30) |
| Total Content of Aliphatic Diol (a) and Aliphatic Diol (b) in Alcohol Component, % by mol | | 100 | 100 | 100 | 100 | 100 | 100 | 100 | 100 | 100 | 100 | 100 |
| Molar Ratio of Aliphatic Diol (a) to Aliphatic Diol (b) | | 60/40 | 70/30 | 80/20 | 90/10 | 95/5 | 100/0 | 50/50 | 40/60 | 70/30 | 70/30 | 70/30 |
| Carboxylic Acid Component | | | | | | | | | | | | |
| Carboxylic Acid Compound | Terephthalic Acid | 2725 g (82) | 2725 g (82) | 2725 g (82) | 2725 g (82) | 2725 g (82) | 2725 g (82) | 2725 g (82) | 2725 g (82) | 3223 g (97) | 2226 g (67) | 1728 g (52) |
| | Trimellitic Anhydride | 384 g (10) | 384 g (10) | 384 g (10) | 384 g (10) | 384 g (10) | 384 g (10) | 384 g (10) | 384 g (10) | — | 769 g (20) | 1153 g (30) |
| Esterification Catalyst | | | | | | | | | | | | |
| Dibutyltin Oxide | | 9 g | 9 g | 9 g | 9 g | 9 g | 9 g | 10 g | 10 g | 10 g | 9 g | 9 g |
| Physical Properties of Resin | | | | | | | | | | | | |
| Softening Point, ° C. | | 130 | 130 | 129 | 132 | 130 | 134 | 131 | 130 | 130 | 132 | 132 |
| Highest Temperature of Endothermic Peak, ° C. | | 66 | 69 | 75 | 79 | 80 | 81 | 63 | 60 | 72 | 68 | 67 |
| Softening Point/Highest Temperature of Endothermic Peak | | 2.0 | 1.9 | 1.7 | 1.7 | 1.6 | 1.7 | 2.1 | 2.2 | 1.8 | 2.0 | 2.0 |
| Glass Transition Temperature, ° C. | | 63 | 67 | 73 | 77 | 78 | 79 | 60 | 58 | 69 | 65 | 63 |
| Acid Value, mgKOH/g | | 49.4 | 46.5 | 43.9 | 43.1 | 41.9 | 37.8 | 49.2 | 49.5 | 44.1 | 51.3 | 52.1 |

Note)
Numerical values inside the parentheses express molar ratios when the total number of moles of the alcohol component is 100.

TABLE A-2

| | | Resin L | Resin M | Resin N | Resin O | Resin P | Resin Q |
|---|---|---|---|---|---|---|---|
| Raw Material Monomers Alcohol Component | | | | | | | |
| Aliphatic Diol (a) | 1,2-Propanediol | — | 1065 g (70) | 1217 g (80) | 1370 g (90) | 913 g (60) | 913 g (60) |
| | 2,3-Butanediol | 1262 g (70) | — | — | — | — | — |
| Aliphatic Diol (b) | Ethanediol | — | — | — | — | 497 g (40) | — |
| | 1,4-Butanediol | 541 g (30) | 541 g (30) | — | — | — | — |
| | 1,6-Hexanediol | — | — | 473 g (20) | — | — | — |
| | 1,8-Octanediol | — | — | — | 180 g (10) | — | — |
| Other Diol | 1,3-Propanediol | — | — | — | — | — | 609 g (40) |
| Total Content of Aliphatic Diol (a) and Aliphatic Diol (b) in Alcohol Component, % by mol | | 100 | 100 | 100 | 100 | 100 | 60 |
| Molar Ratio of Aliphatic Diol (a) to Aliphatic Diol (b) | | 70/30 | 70/30 | 80/20 | 90/10 | 60/40 | 60/0 |
| Carboxylic Acid Component | | | | | | | |
| Carboxylic Acid Compound | Terephthalic Acid | 2725 g (82) | — | 2725 g (82) | 2725 g (82) | 2725 g (82) | 2725 g (82) |
| | Fumaric Acid | — | 1904 g (82) | — | — | — | — |

TABLE A-2-continued

| | | Resin L | Resin M | Resin N | Resin O | Resin P | Resin Q |
|---|---|---|---|---|---|---|---|
| | Trimellitic Anhydride | 384 g (10) | 384 g (10) | 384 g (10) | 384 g (10) | 384 g (10) | 384 g (10) |
| Esterification Catalyst | | | | | | | |
| Dibutyltin Oxide | | 10 g | 8 g | 10 g | 10 g | 9 g | 9 g |
| Polymerization Inhibitor | | | | | | | |
| tert-Butyl Catechol | | — | 1.9 g | — | — | — | — |
| Physical Properties of Resin | | | | | | | |
| Softening Point, ° C. | | 129 | 131 | 132 | 130 | 132 | 131 |
| Highest Temperature of Endothermic Peak, ° C. | | 81 | 63 | 59 | 57 | 75 | 63 |
| Softening Point/Highest Temperature of Endothermic Peak | | 1.6 | 2.1 | 2.2 | 2.3 | 1.8 | 2.1 |
| Glass Transition Temperature, ° C. | | 78 | 61 | 56 | 54 | 72 | 60 |
| Acid Value, mgKOH/g | | 47.9 | 45.3 | 38.9 | 37.5 | 33.4 | 26.4 |

Note)
Numerical values inside the parentheses express molar ratios when the total number of moles of the alcohol component is 100.

TABLE A-3

| | | Resin R | Resin S | Resin T | Resin U | Resin V | Resin W |
|---|---|---|---|---|---|---|---|
| Raw Material Monomers Alcohol Component | | | | | | | |
| Aliphatic Diol (a) | 1,2-Propanediol | 913 g (60) | — | — | — | 685 g (50) | 822 g (60) |
| Aliphatic Diol (b) | Ethanediol | — | 745 g (60) | — | — | — | — |
| | 1,4-Butanediol | — | 721 g (40) | 721 g (40) | 433 g (40) | 568 g (35) | 406 g (25) |
| Other Diols | 1,5-Pentanediol | 833 g (40) | — | 1250 g (60) | — | — | — |
| | BPA-PO[1)] | — | — | — | 2520 g (60) | 945 g (15) | 945 g (15) |
| Total Content of Aliphatic Dial (a) and Aliphatic Diol (b) in Alcohol Component, % by mol | | 60 | 100 | 40 | 40 | 85 | 85 |
| Molar Ratio of Aliphatic Diol (a) to Aliphatic Diol (b) | | 60/0 | 0/100 | 0/40 | 0/40 | 59/41 | 70/30 |
| Carboxylic Acid Component | | | | | | | |
| Carboxylic Acid Compound | Terephthalic Acid | 2725 g (82) | 2725 g (82) | 2725 g (82) | 1635 g (82) | 2452 g (82) | 2452 g (82) |
| | Trimellitic Anhydride | 384 g (10) | 384 g (10) | 384 g (10) | 231 g (10) | 346 g (10) | 346 g (10) |
| Esterification Catalyst | | | | | | | |
| Dibutyltin Oxide | | 10 g | 9 g | 10 g | 10 g | 10 g | 10 g |
| Physical Properties of Resin | | | | | | | |
| Softening Point, ° C. | | 129 | 129 | 131 | 132 | 130 | 130 |
| Highest Temperature of Endothermic Peak, ° C. | | 46 | 26 | 13 | 62 | 67 | 69 |
| Softening Point/Highest Temperature of Endothermic Peak | | 2.8 | 4.9 | 9.9 | 2.1 | 1.9 | 1.9 |
| Glass Transition Temperature, ° C. | | 42 | 22 | 10 | 59 | 64 | 67 |
| Acid Value, mgKOH/g | | 26.3 | 29.4 | 27.6 | 32.5 | 40.1 | 38.8 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane The melting points of the waxes used in Examples and Comparative Examples are listed in Table A-4.

TABLE A-4

| | Chemical Name | Manufacturer and Trade Name | Melting Point, ° C. |
|---|---|---|---|
| Wax a | Paraffin wax | Commercially available from NIPPON SEIRO CO., LTD., HNP-9 | 77 |
| Wax b | Synthesized ester wax | Commercially available from NOF CORPORATION, WEP-9 | 72 |
| Wax c | Carnauba wax | Commercially available from S. Kato & CO., WAX-C1 | 84 |
| Wax d | Paraffin wax | Commercially available from NIPPON SEIRO CO., LTD., FNP-0090 | 90 |
| Wax e | Fischer-Tropsch wax | Commercially available from S. Kato & CO., SP-105 | 105 |
| Wax f | Polypropylene wax | Commercially available from MITSUI CHEMICALS, INC., MITSUI HI WAX NP056 | 127 |
| Wax g | Polypropylene wax | Commercially available from MITSUI CHEMICALS, INC., MITSUI HI WAX NP105 | 140 |

Examples A-1 to A-27, and Comparative Examples A-1 to A-11

Given amounts of resin binders, a wax, and a colorant as listed in Tables A-5 and A-6, and 1.0 part by mass of a charge control agent "BONTRON E-304," commercially available from Orient Chemical Industries Co., Ltd., were mixed with a Henschel mixer, and the mixture was melt-kneaded under the conditions given below.

A continuous twin open-roller type kneader "Kneadex," commercially available from MITSUI MINING COMPANY, LIMITED, having an outer diameter of roller of 14 cm and an effective length of roller of 80 cm, was used. The operating conditions of the continuous twin open-roller type kneader are a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller has a temperature at the raw material supplying side of 75° C., and a temperature at the kneaded product discharging side of 35° C. In addition, the feeding rate of the raw material mixture was 10 kg/h, and the average residence time was about 3 minutes.

The resulting resin melt-kneaded mixture was cooled, and the resin melt-kneaded mixture was then roughly pulverized with a pulverizer "Rotoplex," commercially available from Hosokawa Micron Corporation, to provide a roughly pulverized product having a volume-median particle size of 2 mm or less, using a sieve having a sieve opening of 2 mm. The resulting roughly pulverized product obtained was subjected to fine pulverization with an air jet-type classifier Model DS2, impact jet type, commercially available from Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, commercially available from Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," commercially available from Nippon Aerosil Co., Ltd., number-average particle size: 16 nm, and 1.0 part by mass of a hydrophobic silica "NAX50," commercially available from Nippon Aerosil Co., Ltd., number-average particle size: 30 nm, with a Henschel mixer commercially available from MITSUI MINING COMPANY, LIMITED at 2,100 r/min, i.e. a peripheral speed of 29 msec, for 3 minutes, to provide each of the toners.

Example A-28

Raw materials for a toner were mixed in the same manner as in Example A-2, with a Henschel mixer, and the mixture was melt-kneaded under the conditions given below.

The melt-kneading was carried out with a co-rotating twin-screw extruder PCM-30, commercially available from IKEGAI Corporation, having a screw diameter of 2.9 cm and a cross-sectional area of the screw of 7.06 $cm^2$. The operating conditions were such that the barrel setting temperature was 100° C., a rotational speed of the screw was 200 r/min, i.e. a peripheral speed of the screw rotations was 0.30 msec, and a mixture supplying rate was 10 kg/hr, i.e. a feeding rate of the mixture per unit cross-sectional area of the screw was 1.42 $kg/hr \cdot cm^2$, to provide a resin kneaded mixture.

The resulting resin kneaded mixture was subjected to rough pulverization and fine pulverization in the same manner as in Example A-2, and the finely pulverized product was subjected to a classification treatment, to provide toner matrix particles.

The resulting toner matrix particles were mixed with an external additive in the same manner as in Example A-2, to provide a toner.

Test Example A-1

Low-Temperature Fusing Ability

Each of the toners was loaded to a printer "OKI MICROLINE 5400," commercially available from Oki Data Corporation, modified so as to obtain an unfixed image, and an unfixed image which was a solid image of a square having a side of 2 cm was printed. Thereafter, this unfixed image was subjected to a fusing treatment, with an external fusing device, a modified device of "OKI MICROLINE 3010" commercially available from Oki Data Corporation, at a rotational speed of the fusing roller of 120 mm/sec at each temperature, while raising the fusing roller temperatures from 100° to 230° C. in an increment of 5° C., to provide each of fixed images. A sand-rubber eraser "ER-502R" commercially available from LION Office Products Corp., to which a load of 500 g was applied was moved backward and forward five times over a fixed image obtained at each fusing temperature, and optical densities of the fixed image before and after rubbing were measured with an optical densitometer "GRETAG SPM-50," commercially available from Gretag. The temperature of the fusing roller at which a ratio of optical densities before and after rubbing, i.e. optical densities after rubbing/before rubbing×100, initially exceeds 90% is defined as a lowest fusing temperature, which was used as an index for low-temperature fusing ability. The lower the value, the more excellent the low-temperature fusing ability. The results are shown in Tables A-5 and A-6.

Test Example A-2

Heat-Resistant Storage Property

A metallic cylinder having an inner diameter of 2.8 cm was charged with 10 g of a toner, and a 20-g weight having a diameter of about 2.8 cm was placed on the toner from an upper side, and the toner was allowed to stand at a temperature of 50° C. and relative humidity of 40% for 72 hours. Thereafter, the weight and the cylinder were removed, and the presence or absence of the aggregation of the toner was confirmed. When the toner was aggregated, a weight of a given amount of grams was placed on the toner, to breakdown the toner lumpy mass, and the amount of grams of the weight when the weight was dropped was used as an index for heat-resistant storage property. The amount of grams of 0 g is a case where the toner lumpy mass underwent breakdown simply by removing the cylinder, i.e. the toner was not aggregated. The smaller the value, the more excellent the heat-resistant storage property. The results are shown in Tables A-5 and A-6.

TABLE A-5

| | Resin Binder | | | | | | | | |
|---|---|---|---|---|---|---|---|---|---|
| | Amorphous Polyester (A), parts by mass | Content of Aliphatic Diol (a) in Alcohol Component[1)], % by mol | Content of Aliphatic Diol (b) in Alcohol Component[1)], % by mol | Molar Ratio of Aliphatic Diol (a)/ Aliphatic Diol (b) | Wax, Parts by mass* | Colorant[2)], Parts by Mass* | Kneader | Lowest Fusing Temp., ° C. | Heat-Resistant Storage Property |
| Ex. A-1 | Resin A (100) | 60 | 40 | 60/40 | Wax a (3) | PB15:3 (3.0) | Open roller-type | 130 | 400 |
| Ex. A-2 | Resin B (100) | 70 | 30 | 70/30 | Wax a (3) | PB15:3 (3.0) | Open roller-type | 130 | 30 |
| Ex. A-3 | Resin C (100) | 80 | 20 | 80/20 | Wax a (3) | PB15:3 (3.0) | Open roller-type | 135 | 20 |
| Ex. A-4 | Resin D (100) | 90 | 10 | 90/10 | Wax a (3) | PB15:3 (3.0) | Open roller-type | 140 | 0 |
| Ex. A-5 | Resin E (100) | 95 | 5 | 95/5 | Wax a (3) | PB15:3 (3.0) | Open roller-type | 145 | 0 |
| Ex. A-6 | Resin L (100) | 70 | 30 | 70/30 | Wax a (3) | PB15:3 (3.0) | Open roller-type | 135 | 0 |
| Ex. A-7 | Resin M (100) | 70 | 30 | 70/30 | Wax a (3) | PB15:3 (3.0) | Open roller-type | 130 | 200 |
| Ex. A-8 | Resin N (100) | 80 | 20 | 80/20 | Wax a (3) | PB15:3 (3.0) | Open roller-type | 135 | 500 |
| Ex. A-9 | Resin O (100) | 90 | 10 | 90/10 | Wax a (3) | PB15:3 (3.0) | Open roller-type | 135 | 500 |
| Ex. A-10 | Resin P (100) | 60 | 40 | 60/40 | Wax a (3) | PB15:3 (3.0) | Open roller-type | 145 | 0 |
| Ex. A-11 | Resin I (100) | 70 | 30 | 70/30 | Wax a (3) | PB15:3 (3.0) | Open roller-type | 130 | 20 |
| Ex. A-12 | Resin J (100) | 70 | 30 | 70/30 | Wax a (3) | PB15:3 (3.0) | Open roller-type | 130 | 100 |
| Ex. A-13 | Resin K (100) | 70 | 30 | 70/30 | Wax a (3) | PB15:3 (3.0) | Open roller-type | 130 | 500 |
| Ex. A-14 | Resin B (100) | 70 | 30 | 70/30 | Wax b (3) | PB15:3 (3.0) | Open roller-type | 130 | 50 |
| Ex. A-15 | Resin B (100) | 70 | 30 | 70/30 | Wax c (3) | PB15:3 (3.0) | Open roller-type | 125 | 200 |
| Ex. A-16 | Resin B (100) | 70 | 30 | 70/30 | Wax d (3) | PB15:3 (3.0) | Open roller-type | 130 | 400 |
| Ex. A-17 | Resin B (100) | 70 | 30 | 70/30 | Wax e (3) | PB15:3 (3.0) | Open roller-type | 135 | 500 |
| Ex. A-18 | Resin B (100) | 70 | 30 | 70/30 | Wax a (1.5)<br>Wax g (1.5) | PB15:3 (3.0) | Open roller-type | 130 | 200 |
| Ex. A-19 | Resin B (100) | 70 | 30 | 70/30 | Wax a (0.5) | PB15:3 (3.0) | Open roller-type | 135 | 700 |
| Ex. A-20 | Resin B (100) | 70 | 30 | 70/30 | Wax a (1) | PB15:3 (3.0) | Open roller-type | 135 | 150 |

*Parts by mass based on 100 parts by mass of the resin binder.

[1)]The content in the alcohol component of all the polyesters in the resin binder.

[2)]PB15:3: Phthalocyanine Blue 15:3 commercially available from DAINICHISEIKA COLOR & CHEMICALS MFG. CO., LTD., ECB-301

TABLE A-6

| | Resin Binder | | | | | | | | |
|---|---|---|---|---|---|---|---|---|---|
| | Amorphous Polyester (A), Parts by Mass | Content of Aliphatic Diol (a) in Alcohol Component[1)], % by mol | Content of Aliphatic Diol (b) in Alcohol Component[1)], % by mol | Molar Ratio of Aliphatic Diol (a)/ Aliphatic Diol (b) | Wax, parts by mass* | Colorant[2)], Parts by Mass* | Kneader | Lowest Fusing Temp., ° C. | Heat-Resistant Storage Property |
| Ex. A-21 | Resin B (100) | 70 | 30 | 70/30 | Wax a (6) | PB 15:3 (3.0) | Open roller-type | 125 | 100 |
| Ex. A-22 | Resin B (100) | 70 | 30 | 70/30 | Wax a (12) | PB 15:3 (3.0) | Open roller-type | 125 | 600 |
| Ex. A-23 | Resin B (100) | 70 | 30 | 70/30 | Wax a (3) | PB 15:4 (3.0) | Open roller-type | 130 | 100 |
| Ex. A-24 | Resin B (100) | 70 | 30 | 70/30 | Wax a (3) | CB (3.0) | Open roller-type | 130 | 50 |
| Ex. A-25 | Resin V (100) | 50 | 35 | 59/41 | Wax a (3) | PB 15:3 (3.0) | Open roller-type | 135 | 400 |
| Ex. A-26 | Resin W (100) | 60 | 25 | 70/30 | Wax a (3) | PB 153 (3.0) | Open roller-type | 135 | 200 |
| Ex. A-27 | Resin B (85)<br>Resin F (15) | 74.5 | 253 | 74.5/25.5 | Wax a (3) | PB 15:3 (3.0) | Open roller-type | 135 | 20 |
| Ex. A-28 | Resin B (100) | 70 | 30 | 70/30 | Wax a (3) | PB 15:3 (3.0) | Twin-Screw Extruder | 140 | 400 |
| Comp. Ex. A-1 | Resin F (100) | 100 | — | 100/0 | Wax a (3) | PB 15:3 (3.0) | Open roller-type | 150 | 0 |
| Comp. Ex. A-2 | Resin G (100) | 50 | 50 | 50/50 | Wax a (3) | PB 15:3 (3.0) | Open roller-type | 130 | 800 |
| Comp. Ex. A-3 | Resin H (100) | 40 | 60 | 40/60 | Wax a (3) | PB 15:3 (3.0) | Open roller-type | 130 | 1000 |

TABLE A-6-continued

| | Resin Binder | | | | | | | | |
|---|---|---|---|---|---|---|---|---|---|
| | Amorphous Polyester (A), Parts by Mass | Content of Aliphatic Diol (a) in Alcohol Component[1)], % by mol | Content of Aliphatic Diol (b) in Alcohol Component[1)], % by mol | Molar Ratio of Aliphatic Diol (a)/ Aliphatic Diol (b) | Wax, parts by mass* | Colorant[2)], Parts by Mass* | Kneader | Lowest Fusing Temp., ° C. | Heat-Resistant Storage Property |
| Comp. Ex. A-4 | Resin Q (100) | 60 | — | 100/0 | Wax a (3) | PB 15:3 (3.0) | Open roller-type | 145 | 8000 |
| Comp. Ex. A-5 | Resin R (100) | 60 | — | 100/0 | Wax a (3) | PB 15:3 (3.0) | Open-roller-type | 125 | 20000< |
| Comp. Ex. A-6 | Resin S (100) | — | 100 | 0/100 | Wax a (3) | PB 15:3 (3.0) | Open roller-type | Not pulverizable | |
| Comp. Ex. A-7 | Resin T (100) | — | 40 | 0/100 | Wax a (3) | PB 15:3 (3.0) | Open roller-type | Not pulverizable | |
| Comp. Ex. A-8 | Resin U (100) | — | 40 | 0/100 | Wax a (3) | PB 15:3 (3.0) | Open roller-type | 150 | 300 |
| Comp. Ex. A-9 | Resin B (100) | 70 | 30 | 70/30 | Wax f (3) | PB 15:3 (3.0) | Open roller-type | 135 | 800 |
| Comp. Ex. A-10 | Resin B (100) | 70 | 30 | 70/30 | Wax g (3) | PB15:3 (3.0) | Open roller-type | 135 | 1000 |
| Comp. Ex. A-11 | Resin B (100) | 70 | 30 | 70/30 | Wax a (15) | PB15:3 (3.0) | Open roller-type | 125 | 1000 |

*Parts by mass based on 100 parts by mass of the resin binder.

[1)]The content in the alcohol component of all the polyesters in the resin binder.

[2)]PB 153: Phthalocyanine Blue 15:3 commercially available from DAINICHISEIKA COLOR & CHEMICALS MFG. CO., LTD., ECB-301

PB 15:4: Phthalocyanine Blue 15:4 commercially available from DAINICHISEWA COLOR & CHEMICALS MFG. CO., LTD., ZCN-907

CB: Carbon black commercially available from Cabot Corporation, REGAL 330R

It can be seen from the above results that the toners of Examples A-1 to A-28 have not only excellent low-temperature fusing ability but also heat-resistant storage property, as compared to those of Comparative Examples A-1 to A-11.

Production Example B-1 for Amorphous Resins

Resins A to F, Resin I, Resin J, Resin M, and Resins o to q

A 5-liter four-neck flask equipped with a nitrogen inlet tube, a dehydration tube, a stirrer, and a thermocouple was charged with raw material monomers other than trimellitic anhydride, and an esterification catalyst as listed in Tables B-1 and B-2. The temperature was raised to 200° C. in a nitrogen atmosphere, and the components were reacted at that temperature for 6 hours. Further, the temperature was raised to 210° C., trimellitic anhydride was added to the reaction mixture, and the components were reacted at an ambient pressure, 101.3 kPa, for 1 hour, and further reacted at 40 kPa until a desired softening point was reached. The physical properties of the resins obtained are shown in Tables B-1 and B-2.

Production Example B-2 for Amorphous Resins

Resin G and Resin K

A 5-liter four-neck flask equipped with a nitrogen inlet tube, a dehydration tube, a stirrer, and a thermocouple was charged with raw material monomers other than trimellitic anhydride, an esterification catalyst, and a polymerization inhibitor as listed in Tables B-1 and B-2. The temperature was raised to 200° C. in a nitrogen atmosphere, and the components were reacted at that temperature for 6 hours. Further, the temperature was raised to 210° C., and the components were then reacted at an ambient pressure, 101.3 kPa, for 1 hour, and further reacted at 40 kPa until a desired softening point was reached. The physical properties of the resins obtained are shown in Tables B-1 and B-2.

Production Example B-3 for Amorphous Resins

Resin H and Resin L

A 5-liter four-neck flask equipped with a nitrogen inlet tube, a dehydration tube, a stirrer, and a thermocouple was charged with raw material monomers and an esterification catalyst as listed in Tables B-1 and B-2. The temperature was raised to 200° C. in a nitrogen atmosphere, and the components were reacted at that temperature for 6 hours. Further, the temperature was raised to 210° C., and the components were then reacted at an ambient pressure, 101.3 kPa, for 1 hour, and further reacted at 40 kPa until a desired softening point was reached. The physical properties of the resins obtained are shown in Tables B-1 and B-2.

TABLE B-1

| | | Resin A | Resin B | Resin C | Resin D | Resin E | Resin F | Resin G | Resin H |
|---|---|---|---|---|---|---|---|---|---|
| Raw Material Monomers Alcohol Component | | | | | | | | | |
| Aliphatic Diol (a) | 1,2-Propanediol | 609 g (40) | 913 g (60) | 1065 g (70) | 1217 g (80) | 1370 g (90) | — | 1065 g (70) | 1065 g (70) |
| | 2,3-Butanediol | — | — | — | — | — | 1262 g (70) | — | — |
| Aliphatic Diol (b) | 1,4-Butanedial | 1081 g (60) | 721 g (40) | 541 g (30) | 360 g (20) | 180 g (10) | 541 g (30) | 541 g (30) | 541 g (30) |
| Total Content of Aliphatic Diol (a) and Aliphatic Diol (b) in Alcohol Component, % by mol | | 100 | 100 | 100 | 100 | 100 | 100 | 100 | 100 |
| Molar Ratio of Aliphatic Diol (a) to Aliphatic Diol (b) | | 40/60 | 60/40 | 70/30 | 80/20 | 90/10 | 70/30 | 70/30 | 70/30 |
| Carboxylic Acid Component | | | | | | | | | |
| Carboxylic Acid Compound | Terephthalic Acid | 2725 g (82) | 2725 g (82) | 2725 g (82) | 2725 g (82) | 2725 g (82) | 2725 g (82) | — | 3223 g (97) |
| | Fumaric Acid | — | — | — | — | — | — | 1904 g (82) | — |
| | Trimellitic Anhydride | 384 g (10) | 384 g (10) | 384 g (10) | 384 g (10) | 384 g (10) | 384 g (10) | 384 g (10) | — |
| Esterification Catalyst | | | | | | | | | |
| Dibutyltin Oxide | | 10 g | 9 g | 9 g | 9 g | 9 g | 10 g | 8 g | 10 g |
| Polymerization Inhibitor | | | | | | | | | |
| tert-Butyl Catechol | | — | — | — | — | — | — | 1.9 g | — |
| Physical Properties of Resin | | | | | | | | | |
| Softening Point, ° C. | | 130 | 130 | 130 | 129 | 132 | 129 | 131 | 130 |
| Glass Transition Temperature, ° C. | | 58 | 63 | 67 | 73 | 77 | 78 | 61 | 69 |
| Highest Temperature of Endothermic Peak, ° C. | | 60 | 66 | 69 | 75 | 79 | 80 | 63 | 71 |
| Softening Point/Highest Temperature of Endothermic Peak | | 2.2 | 2.0 | 1.9 | 1.7 | 1.7 | 1.6 | 2.1 | 1.8 |
| Acid Value, mgKOH/g | | 49.5 | 49.4 | 46.5 | 43.9 | 43.1 | 47.9 | 45.3 | 44.1 |

Note)
Numerical values inside the parentheses express molar ratios when the total number of moles of the alcohol component is 100.

TABLE B-2

| | | Resin I | Resin J | Resin K | Resin L | Resin M | Resin o | Resin p | Resin q |
|---|---|---|---|---|---|---|---|---|---|
| Raw Material Monomers Alcohol Component | | | | | | | | | |
| Aliphatic Diol (a) | 1,2-Propanediol | 822 g (60) | — | 609 g (40) | 609 g (40) | 479 g (35) | 1522 g (100) | — | — |
| | 2,3-Butanediol | — | 721 g (40) | — | — | — | — | — | — |
| Aliphatic Dial (b) | 1,4-Butanediol | 406 g (25) | 1081 g (60) | 1081 g (60) | 1081 g (60) | 811 g (50) | — | 324 g (30) | 649 g (60) |
| Other Diol | BPA-PO[1)] | 945 g (15) | — | — | — | 945 g (15) | — | 2940 g (70) | 1680 g (40) |
| Total Content of Aliphatic Diol (a) and Aliphatic Diol (b) in Alcohol Component, % by mol | | 85 | 100 | 100 | 100 | 85 | 100 | 30 | 60 |
| Molar Ratio of Aliphatic Diol (a) to Aliphatic Diol (b) | | 71/29 | 40/60 | 40/60 | 40/60 | 41/59 | 100/0 | 0/30 | 0/60 |
| Carboxylic Acid Component | | | | | | | | | |
| Carboxylic Acid Compound | Terephthalic Acid | 2452 g (82) | 2725 g (82) | — | 3223 g (97) | 2452 g (82) | 2725 g (82) | 1635 g (82) | 1635 g (82) |
| | Fumaric Acid | — | — | 1904 g (82) | — | — | — | — | — |
| | Trimellitic Anhydride | 346 g (10) | 384 g (10) | 384 g (10) | — | 346 g (10) | 384 g (10) | 231 g (10) | 231 g (10) |

TABLE B-2-continued

| | Resin I | Resin J | Resin K | Resin L | Resin M | Resin o | Resin p | Resin q |
|---|---|---|---|---|---|---|---|---|
| Esterification Catalyst | | | | | | | | |
| Dibutyltin Oxide | 10 g | 10 g | 8 g | 10 g | 10 g | 9 g | 8 g | 8 g |
| Polymerization Inhibitor | | | | | | | | |
| tert-Butyl Catechol | — | — | 2.0 g | — | — | — | — | — |
| Physical Properties of Resin | | | | | | | | |
| Softening Point, ° C. | 130 | 130 | 129 | 131 | 130 | 134 | 131 | 131 |
| Glass Transition Temperature, ° C. | 67 | 67 | 52 | 62 | 62 | 79 | 60 | 51 |
| Highest Temperature of Endothermic Peak, ° C. | 69 | 69 | 55 | 64 | 65 | 81 | 62 | 53 |
| Softening Point/Highest Temperature of Endothermic Peak | 1.9 | 1.9 | 2.3 | 2.0 | 2.0 | 1.7 | 2.1 | 2.5 |
| Acid Value, mgKOH/g | 38.8 | 482 | 46.9 | 42.5 | 39.5 | 37.8 | 313 | 33.6 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane

Production Example B-1 for Crystalline Resin

Resin r

A 10-liter four-neck flask equipped with a nitrogen inlet tube, a dehydration tube, a stirrer, and a thermocouple was charged with raw material monomers, an esterification catalyst, and a polymerization inhibitor as listed in Table B-3. The temperature was raised from 130° to 200° C. over 10 hours in a nitrogen atmosphere, and the components were reacted at 200° C. and 8 kPa, for 1 hour. The physical properties of the resin r obtained are shown in Table B-3.

Production Example B-2 for Crystalline Resin

Resin s

A 10-liter four-neck flask equipped with a nitrogen inlet tube, a dehydration tube, a stirrer, and a thermocouple was charged with raw material monomers other than trimellitic anhydride and an esterification catalyst as listed in Table B-3. The components were reacted at 200° C. in a nitrogen atmosphere until a reaction percentage reached 90%, and the components were then reacted at 8 kPa for 1 hour. Thereafter, the pressure was recovered to an ambient pressure, trimellitic anhydride was supplied thereto, and the components were reacted at 200° C. and an ambient pressure for 2 hours. The physical properties of the resin s obtained are shown in Table B-3. Here, the reaction percentage refers to a value calculated by [amount of water generated/theoretical amount of water generated]×100.

TABLE B-3

| Crystalline Resin | Resin r | Resin s |
|---|---|---|
| Raw Material Monomers | | |
| 1,6-Hexanediol | 4490 g (100) | 3143 g (70) |
| 1,4-Butanediol | — | 1027 g (30) |
| Terephthalic Acid | — | 5051 g (80) |
| Fumaric Acid | 4411 g (100) | — |

TABLE B-3-continued

| Crystalline Resin | Resin r | Resin s |
|---|---|---|
| Trimellitic Anhydride | — | 438 g (6) |
| Esterification Catalyst | | |
| Tin(II) 2-Ethylhexanoate | 18 g | 19 g |
| Polymerization Inhibitor | | |
| tert-Butyl Catechol | 4.5 g | — |
| Physical Properties of Crystalline Resin | | |
| Softening Point, ° C. | 110 | 108 |
| Highest Temperature of Endothermic Peak: Melting Point, ° C. | 111 | 110 |
| Softening Point/Highest Temperature of Endothermic Peak | 1.0 | 1.0 |

Note)
Numerical values inside the parentheses express molar ratios when the total number of moles of the alcohol component is 100.

Production Example B-3 for Crystalline Resin

Resin t

A 10-liter four-neck flask equipped with a nitrogen inlet tube, a dehydration tube, a stirrer, and a thermocouple was charged with raw material monomers of the polycondensation resin component other than acrylic acid, a dually reactive monomer, in given amounts as listed in Table B-4. The contents were heated to 160° C. to dissolve. To the solution was added dropwise over an hour a solution of styrene, dicumyl peroxide, and acrylic acid previously mixed. The mixture was continued stirring for 1 hour while keeping the temperature to 170° C. to polymerize styrene and acrylic acid. Thereafter, 40 g of tin(II) 2-ethylhexanoate and 3 g of gallic acid were added to the polymerization mixture, the temperature was raised to 210° C., and the components were reacted at that temperature for 8 hours. Further, the components were reacted at 8.3 kPa for 1 hour, to provide a resin t. The physical properties of the resulting resin t are shown in Table B-4.

TABLE B-4

| Crystalline Resin | Resin t |
|---|---|
| Raw Material Monomers | |
| Raw Material Monomers (P) for Polycondensation Resin Component[1)] | |
| 1,6-Hexanediol | 2313 g (70) |
| 1,4-Butanediol | 756 g (30) |
| Terephthalic Acid | 3347 g (72) |
| Acrylic Acid (Dually Reactive Monomer) | 202 g (10) |
| Raw Material Monomers (S) for Styrenic Resin Component[2)] | |
| Styrene | 2593 g (100) |
| Dicumyl Peroxide (Polymerization Initiator) | 156 g (6) |
| Total Amount of P/Total Amount of S (Mass Ratio)[3)] | 72/28 |
| Physical Properties of Crystalline Resin | |
| Glass Transition Temperature of Styrenic Resin Component According to Fox's Formula, ° C.: Tg1 | 100 |
| Glass Transition Temperature of Crystalline Resin, ° C.: Tg2 | 20 |
| Tg1 − Tg2 | 80 |
| Softening Point, ° C. | 104 |
| Highest Temperature of Endothermic Peak: Melting Point, ° C. | 105 |
| Softening Point/Highest Temperature of Endothermic Peak | 1.0 |

[1)]Numerical values inside the parentheses of the raw material monomers for the polycondensation resin component express molar ratios when the total number of moles of the alcohol component is 100.
[2)]Numerical values inside the parentheses of the raw material monomers for the styrenic resin component express mass ratios when the mass of styrene is 100.
[3)]The total amount of the raw material monomers for the styrenic resin component does not include dicumyl peroxide.

Examples B-1 to B-14, and Comparative Examples B-1 to B-5

Resin binders in given amounts as listed in Tables B-5 and B-6, 3.0 parts by mass of a wax "Carnauba Wax C1," commercially available from S. Kato & CO., melting point: 88° C., 5.0 parts by mass of a colorant "ECB-301," commercially available from DAINICHISEIKA COLOR & CHEMICALS MFG. CO., LTD., Phthalocyanine Blue, P.B. 15:3 and 1.0 part by mass of a charge control agent "BONTRON E-304," commercially available from Orient Chemical Industries Co., Ltd., were mixed with a Henschel mixer, and the mixture was melt-kneaded under the conditions given below.

A continuous twin open-roller type kneader "Kneadex," commercially available from MITSUI MINING COMPANY, LIMITED, having an outer diameter of roller of 14 cm and an effective length of roller of 80 cm, was used. The operating conditions of the continuous twin open-roller type kneader are a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller has a temperature at the raw material supplying side of 75° C., and a temperature at the kneaded product discharging side of 35° C. In addition, the feeding rate of the raw material mixture was 10 kg/h, and the average residence time was about 3 minutes.

The resulting resin melt-kneaded mixture was cooled, and the resin melt-kneaded mixture was then roughly pulverized with a pulverizer "Rotoplex," commercially available from Hosokawa Micron Corporation, to provide a roughly pulverized product having a volume-median particle size of 2 mm or less, using a sieve having a sieve opening of 2 mm. The resulting roughly pulverized product obtained was subjected to fine pulverization with an air jet-type classifier Model DS2, impact jet type, commercially available from Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, commercially available from Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," commercially available from Nippon Aerosil Co., Ltd., number-average particle size: 16 nm, and 1.0 part by mass of a hydrophobic silica "NAX50," commercially available from Nippon Aerosil Co., Ltd., number-average particle size: 30 nm, with a Henschel mixer commercially available from MITSUI MINING COMPANY, LIMITED at 2,100 r/min, i.e. a peripheral speed of 29 msec, for 3 minutes, to provide each of the toners.

Example B-15

The same procedures as in Example B-2 were carried out except that 5.0 parts by mass of "Fischer-Tropsch wax SP-105," commercially available from S. Kato & CO., melting point: 105° C., was used in place of 3.0 parts by mass of "Carnauba wax WAX-C1" as a wax, to provide a toner.

Text Example B-1

Gloss

Each of the toners was loaded in a nonmagnetic monocomponent developer device "OKI MICROLINE 5400," commercially available from Oki Data Corporation. With adjusting the amount of toner adhesion to 0.40±0.03 mg/cm$^2$, a solid image having a size of 4.1 cm×4.1 cm was printed on J sheet, commercially available from Fuji Xerox Co., Ltd. The solid image was taken out before passing through a fusing device, to provide an unfixed image. A sheet containing the resulting unfixed image was fed to a nonmagnetic monocomponent developer device "OKI MICROLINE 5400," commercially available from Oki Data Corporation, and a solid image having a size of 4.1 cm×4.1 cm was again printed thereon. The solid image was taken out before passing through a fusing device, to provide a two-layered unfixed image, having an amount of toner adhesion of 0.80±0.06 mg/cm$^2$. The same procedures were repeated, to provide a three-layered unfixed image having an amount of toner adhesion of 1.20±0.09 mg/cm$^2$.

The resulting three-layered unfixed image was fused with an external fusing device, which was a fusing device obtained from "OKI MICROLINE 3010," commercially available from Oki Data Corporation for external fusing, while setting the temperature of the fusing roller to 100° C. and a fusing speed to 120 mm/sec. Thereafter, the same procedures were carried out with setting the fusing roller temperature at 105° C., and raising the temperature to 190° C. in an increment of 5° C. The glossiness of the resulting three-layered fixed image at each fusing temperature was measured, and a maximum value thereof is defined as gloss of the sample. The glossiness was measured with a Gloss Meter "PG-1," commercially available from NIPPON DENSHOKU INDUSTRIES CO., LTD., with a light source set at an angle of 60°. The higher the glossiness, the more excellent the gloss. The results are shown in Tables B-5 and B-6.

Test Example B-2

High-Temperature Offset Resistance

Each of the toners was loaded in a nonmagnetic monocomponent developer device "OKI MICROLINE 5400," commercially available from Oki Data Corporation. With adjusting the amount of toner adhesion to 0.40±0.03 mg/cm$^2$, a solid image having a size of 4.1 cm×4.1 cm was printed on J sheet, commercially available from Fuji Xerox Co., Ltd. The solid image was taken out before passing through a fusing device, to provide an unfixed image. The resulting unfixed image was fused with an external fusing device, which was a fusing device obtained from "OKI MICROLINE 3010" commercially available from Oki Data Corporation for external fusing, while setting the temperature of the fusing roller to 100° C. and a fusing speed to 100 mm/sec. Thereafter, the same procedures were carried out with setting the fusing roller temperature at 105° C., and raising the temperature to 200° C. in an increment of 5° C.

The resulting fixed images at a temperature of from 100° to 200° C. were visually confirmed, and a highest temperature of the fusing roller at which hot offsetting was not generated is defined as a highest fusing temperature. The results are shown in Tables B-5 and B-6. In a fixed image at 200° C., a case where hot generation is not generated is listed as "200<."

TABLE B-5

| | Resin Binders | | | | | |
|---|---|---|---|---|---|---|
| | Amorphous Resin | | | | | |
| | Kinds, Parts by Mass | Content of Aliphatic Diol (a) in Alcohol Component[1)], % by mol | Content of Aliphatic Diol (b) in Alcohol Component[1)], % by mol | Crystalline Resin, Parts by Mass | Gloss | High-Temperature Offset Resistance, ° C. |
| Ex. B-1 | Resin C (90) | 70 | 30 | Resin r (10) | 33 | 200< |
| Ex. B-2 | Resin C (80) | 70 | 30 | Resin r (20) | 35 | 200< |
| Ex. B-3 | Resin C (70) | 70 | 30 | Resin r (30) | 35 | 190 |
| Ex. B-4 | Resin C (60) | 70 | 30 | Resin r (40) | 35 | 180 |
| Ex. B-5 | Resin B (80) | 60 | 40 | Resin r (20) | 35 | 200< |
| Ex. B-6 | Resin D (80) | 80 | 20 | Resin r (20) | 34 | 200< |
| Ex. B-7 | Resin E (80) | 90 | 10 | Resin r (20) | 34 | 195 |
| Ex. B-8 | Resin F (80) | 70 | 30 | Resin r (20) | 33 | 200< |
| Ex. B-9 | Resin G (80) | 70 | 30 | Resin r (20) | 35 | 200< |
| Ex. B-10 | Resin H (80) | 70 | 30 | Resin r (20) | 35 | 200< |
| Ex. B-11 | Resin I (80) | 60 | 25 | Resin r (20) | 32 | 190 |
| Ex. B-12 | Resin C (80) | 70 | 30 | Resin s (20) | 34 | 200< |
| Ex. B-13 | Resin C (80) | 70 | 30 | Resin t (20) | 33 | 200< |
| Ex. B-14 | Resin C (65)<br>Resin o (15) | 75.6 | 24.4 | Resin r (20) | 31 | 200< |
| Ex. B-15 | Resin C (80) | 70 | 30 | Resin r (20) | 31 | 200< |

[1)]The content in the alcohol component of all the amorphous polyesters in the amorphous resin.

TABLE B-6

| | Resin Binders | | | | | |
|---|---|---|---|---|---|---|
| | Amorphous Resin | | | | | |
| | Kinds, Parts by Mass | Content of Aliphatic Diol (a) in Alcohol Component[1)], % by mol | Content of Aliphatic Diol (b) in Alcohol Component[1)], % by mol | Crystalline Resin, Parts by Mass | Gloss | High-Temperature Offset Resistance, ° C. |
| Comp. Ex. B-1 | Resin o (80) | 100 | 0 | Resin r (20) | 34 | 170 |
| Comp. Ex. B-2 | Resin p (80) | 0 | 30 | Resin r (20) | 31 | 165 |
| Comp. Ex. B-3 | Resin q (80) | 0 | 60 | Resin r (20) | 32 | 170 |
| Comp. Ex. B-4 | Resin A (100) | 40 | 60 | — | 24 | 200< |
| Comp. Ex. B-5 | Resin A (50) | 40 | 60 | Resin r (50) | 37 | 165 |

[1)]The content in the alcohol component of all the amorphous polyesters in the amorphous resin.

It can be seen from the above results that the toners of Examples B-1 to B-15 have excellent gloss and high-temperature offset resistance, as compared to those of Comparative Examples B-1 to B-5.

Production Example C-1 for Resins

Resins A to F, Resin I, Resin J, Resin M, and Resins o to q

A 5-liter four-neck flask equipped with a nitrogen inlet tube, a dehydration tube, a stirrer, and a thermocouple was charged with raw material monomers other than trimellitic anhydride, and an esterification catalyst as listed in Tables C-1 and C-2. The temperature was raised to 200° C. in a nitrogen atmosphere, and the components were reacted at that temperature for 6 hours. Further, the temperature was raised to 210° C., trimellitic anhydride was then added to the reaction mixture, and the components were reacted at an ambient pressure, 101.3 kPa, for 1 hour, and further reacted at 40 kPa until a desired softening point was reached. The physical properties of the resins obtained are shown in Tables C-1 and C-2.

Production Example C-2 for Resins

Resin G and Resin K

A 5-liter four-neck flask equipped with a nitrogen inlet tube, a dehydration tube, a stirrer, and a thermocouple was charged with raw material monomers other than trimellitic anhydride, an esterification catalyst, and a polymerization inhibitor, as listed in Tables C-1 and C-2. The temperature was raised to 200° C. in a nitrogen atmosphere, and the components were reacted at that temperature for 6 hours. Further, the temperature was raised to 210° C., trimellitic anhydride was then added to the reaction mixture, and the components were reacted at an ambient pressure, 101.3 kPa, for 1 hour, and further reacted at 40 kPa until a desired softening point was reached. The physical properties of the resins obtained are shown in Tables C-1 and C-2.

Production Example C-3 for Resins

Resin H and Resin L

A 5-liter four-neck flask equipped with a nitrogen inlet tube, a dehydration tube, a stirrer, and a thermocouple was charged with raw material monomers and an esterification catalyst as listed in Tables C-1 and C-2. The temperature was raised to 200° C. in a nitrogen atmosphere, and the components were reacted at that temperature for 6 hours. Further, the temperature was raised to 210° C., and the components were reacted at an ambient pressure, 101.3 kPa, for 1 hour, and further reacted at 40 kPa until a desired softening point was reached. The physical properties of the resins obtained are shown in Tables C-1 and C-2.

TABLE C-1

| | | Resin A | Resin B | Resin C | Resin D | Resin E | Resin F | Resin G | Resin H |
|---|---|---|---|---|---|---|---|---|---|
| Raw Material Monomers Alcohol Component | | | | | | | | | |
| Aliphatic Diol (a) | 1,2-Propanediol | 609 g (40) | 913 g (60) | 1065 g (70) | 1217 g (80) | 1370 g (90) | — | 1332 g (70) | 1065 g (70) |
| | 2,3-Butanediol | — | — | — | — | — | 1262 g (70) | — | — |
| Aliphatic Diol (b) | 1,4-Butanediol | 1081 g (60) | 721 g (40) | 541 g (30) | 360 g (20) | 180 g (10) | 541 g (30) | 676 g (30) | 541 g (30) |
| Total Content of Aliphatic Diol (a) and Aliphatic Diol (b) in Alcohol Component, % by mol | | 100 | 100 | 100 | 100 | 100 | 100 | 100 | 100 |
| Molar Ratio of Aliphatic Diol (a) to Aliphatic Diol (b) | | 40/60 | 60/40 | 70/30 | 80/20 | 90/10 | 70/30 | 70/30 | 70/30 |
| Carboxylic Acid Component | | | | | | | | | |
| Carboxylic Acid Compound | Terephthalic Acid | 2824 g (85) | 2824 g (85) | 2824 g (85) | 2824 g (85) | 2824 g (85) | 2824 g (85) | — | 2974 g (90) |
| | Fumaric Acid | — | — | — | — | — | — | 2466 g (85) | — |
| | Trimellitic Anhydride | 115 g (3) | 115 g (3) | 115 g (3) | 115 g (3) | 115 g (3) | 115 g (3) | 144 g (3) | — |
| Esterification Catalyst | | | | | | | | | |
| Dibutyltin Oxide | | 9 g | 9 g | 9 g | 9 g | 9 g | 9 g | 9 g | 9 g |
| Polymerization Inhibitor | | | | | | | | | |
| tert-Butyl Catechol | | — | — | — | — | — | — | 2.3 g | — |
| Physical Properties of Resin | | | | | | | | | |
| Softening Point, ° C. | | 140 | 139 | 140 | 139 | 141 | 139 | 140 | 141 |
| Highest Temperature of Endothermic Peak, ° C. | | 59 | 65 | 67 | 68 | 70 | 70 | 58 | 67 |
| Softening Point/Highest Temperature of Endothermic Peak | | 2.4 | 2.1 | 2.1 | 2.0 | 2.0 | 2.0 | 2.4 | 2.1 |
| Glass Transition Temperature, ° C. | | 56 | 63 | 64 | 65 | 68 | 67 | 55 | 64 |
| Acid Value, mgKOH/g | | 14.8 | 14.7 | 14.1 | 14.3 | 13.9 | 14.7 | 14.0 | 12.2 |

Note)
Numerical values inside the parentheses express molar ratios when the total number of moles of the alcohol component is 100.

TABLE C-2

| | | Resin I | Resin J | Resin K | Resin L | Resin M | Resin o | Resin p | Resin q |
|---|---|---|---|---|---|---|---|---|---|
| Raw Material Monomers Alcohol Component | | | | | | | | | |
| Aliphatic Diol (a) | 1,2-Propanediol | 822 g (60) | — | 609 g (40) | 609 g (40) | 479 g (35) | 1522 g (100) | — | — |
| | 2,3-Butanediol | — | 721 g (40) | — | — | — | — | — | — |
| Aliphatic Diol (b) | 1,4-Butanediol | 406 g (25) | 1081 g (60) | 1081 g (60) | 1081 g (60) | 811 g (50) | — | 324 g (30) | 649 g (60) |
| Other Diol | BPA-PO[1)] | 945 g (15) | — | — | — | 945 g (15) | — | 2940 g (70) | 1680 g (40) |
| Total Content of Aliphatic Diol (a) and Aliphatic Diol (b) in Alcohol Component, % by mol | | 85 | 100 | 100 | 100 | 85 | 100 | 30 | 60 |
| Molar Ratio of Aliphatic Diol (a) to Aliphatic Diol (b) | | 71/29 | 40/60 | 40/60 | 40/60 | 41/59 | 100/0 | 0/30 | 0/60 |
| Carboxylic Acid Component | | | | | | | | | |
| Carboxylic Acid Compound | Terephthalic Acid | 2542 g (85) | 2824 g (85) | — | 2974 g (90) | 2542 g (85) | 2824 g (85) | 1695 g (85) | 1635 g (82) |
| | Fumaric Acid | — | — | 1973 g (85) | — | — | — | — | — |
| | Trimellitic Anhydride | 104 g (3) | 115 g (3) | 115 g (3) | — | 115 g (3) | 115 g (3) | 69 g (3) | 231 g (10) |
| Esterification Catalyst | | | | | | | | | |
| Dibutyltin Oxide | | 10 g | 9 g | 8 g | 9 g | 10 g | 9 g | 8 g | 8 g |
| Polymerization Inhibitor | | | | | | | | | |
| tert-Butyl Catechol | | — | — | 1.9 g | — | — | — | — | — |
| Physical Properties of Resin | | | | | | | | | |
| Softening Point, ° C. | | 142 | 140 | 140 | 141 | 143 | 141 | 140 | 142 |
| Highest Temperature of Endothermic Peak, ° C. | | 65 | 62 | 53 | 62 | 57 | 75 | 66 | 53 |
| Softening Point/Highest Temperature of Endothermic Peak | | 2.2 | 2.2 | 2.6 | 2.3 | 2.5 | 1.9 | 2.1 | 2.7 |
| Glass Transition Temperature, ° C. | | 63 | 59 | 50 | 59 | 54 | 72 | 63 | 50 |
| Acid Value, mgKOH/g | | 14.5 | 15.1 | 14.3 | 13.2 | 14.9 | 12.6 | 14.3 | 15.6 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane

Examples C-1 to C-14, and Comparative Examples C-1 to C-6

Resin binders, a charge control resin "FCA-201PS," commercially available from FUJIKURA KASEI CO., LTD., denoted as C-1, softening point: 125° C. and a charge control agent "BONTRON P-51," commercially available from Orient Chemical Industries Co., Ltd., denoted as C-2, a quaternary ammonium salt compound, or "TP-415," commercially available from Hodogaya Chemical Co., Ltd., denoted as C-3, a quaternary ammonium salt compound, in given amounts as listed in Tables C-3 and C-4, 3 parts by mass of a wax "Carnauba Wax C1," commercially available from S. Kato & CO., melting point: 88° C., and 5.0 parts by mass of a colorant "ECB-301," commercially available from DAINICHISEIKA COLOR & CHEMICALS MFG. CO., LTD., Phthalocyanine Blue, P.B. 15:3, were mixed with a Henschel mixer, and the mixture was melt-kneaded under the conditions given below.

A continuous twin open-roller type kneader "Kneadex," commercially available from MITSUI MINING COMPANY, LIMITED, having an outer diameter of roller of 14 cm and an effective length of roller of 80 cm, was used. The operating conditions of the continuous twin open-roller type kneader are a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller has a temperature at the raw material supplying side of 75° C., and a temperature at the kneaded product discharging side of 35° C. In addition, the feeding rate of the raw material mixture was 10 kg/h, and the average residence time was about 3 minutes.

The resulting resin melt-kneaded mixture was cooled, and the resin melt-kneaded mixture was then roughly pulverized with a pulverizer "Rotoplex," commercially available from Hosokawa Micron Corporation, to provide a roughly pulverized product having a volume-median particle size of 2 mm or less, using a sieve having a sieve opening of 2 mm. The resulting roughly pulverized product obtained was subjected to fine pulverization with an air jet-type classifier Model DS2, impact jet type, commercially available from Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, commercially available from Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," commercially available from Nippon Aerosil Co., Ltd., number-average particle size: 16 nm, and 1.0 part by mass of a hydrophobic silica "NAX50," commercially available from Nippon Aerosil Co., Ltd., number-average particle size: 30 nm, with a Henschel mixer commercially available from MITSUI MINING COMPANY, LIMITED at 2,100 r/min, i.e. a peripheral speed of 29 msec, for 3 minutes, to provide each of the toners.

Example C-15

The same procedures as in Example C-1 were carried out except that 5.0 parts by mass of "Fischer-Tropsch wax SP-105," commercially available from S. Kato & CO., melting point: 105° C., was used in place of 3.0 parts by mass of "Carnauba wax WAX-C1" as a wax, to provide a toner.

Example C-16

Raw materials for a toner were mixed in the same manner as in Example C-3, with a Henschel mixer, and the mixture was melt-kneaded under the conditions given below.

The melt-kneading was carried out with a co-rotating twin-screw extruder PCM-30, commercially available from IKEGAI Corporation, having a screw diameter of 2.9 cm and a cross-sectional area of the screw of 7.06 $cm^2$. The operating conditions were such that the barrel setting temperature was 100° C., a rotational speed of the screw was 200 r/min, i.e. a peripheral speed of the screw rotations was 0.30 m/sec, and a mixture supplying rate was 10 kg/h, i.e. a feeding rate of the mixture per unit cross-sectional area of the screw was 1.42 $kg/h \cdot cm^2$, to provide a resin kneaded mixture.

The resulting resin kneaded mixture was subjected to rough pulverization and fine pulverization in the same manner as in Example C-3, and the finely pulverized product was subjected to a classification treatment, to provide toner matrix particles.

The resulting toner matrix particles were mixed with external additives in the same manner as in Example C-3, to provide a toner.

Test Example C-1

Gloss

Each of the toners was loaded in a printer "HL-2040," commercially available from Brother Industries, Ltd., modified so as to obtain an unfixed image, and a solid image having a size of 2 cm×2 cm of the unfixed image was printed on J sheet, commercially available from Fuji Xerox Co., Ltd. The unfixed image was subjected to fusing treatment with an external fusing device, a modified device of an oilless fusing system "DL-2300," commercially available from Konica Minolta Business Solutions Japan Co., Ltd., while setting a rotational speed of the fusing roller to 265 mm/sec, and setting the temperature of the fusing roller in the fusing device to 170° C., to provide a fixed image. The glossiness was measured using each of the fixed images. The glossiness was measured with a gloss meter "PG-1," commercially available from NIPPON DENSHOKU INDUSTRIES CO., LTD., with a light source set at an angle of 60°. The higher the glossiness, the more excellent the gloss. The results are shown in Tables C-3 and C-4.

Test Example C-2

Background Fogging

Each of the toners was loaded in a printer "HL-2040" commercially available from Brother Industries Ltd., equipped with a cleaner-less development system, and the printing of a fixed image having a print coverage of 1% was carried out intermittently for 2,000 sheets under conditions of 20 seconds per page. Blank images were printed every 500 sheets, and a power source was turned off during the course of printing. Thereafter, the toner on the photoconductor surface was adhered to "Scotch (registered trademark) Mending Tape 810" commercially available from SUMITOMO 3M LIMITED, width: 18 mm, and a coloration density was measured with an image densitometer "GRETAG SPM-50" commercially available from Gretag. A difference between the found coloration density and the coloration density of the tape itself before the toner adhesion was obtained, and an average of four found values of coloration densities taken from 500th sheet to 2,000th sheet was obtained. The smaller the value, the more suppressed the background fogging. The results are shown in Tables C-3 and C-4.

TABLE C-3

| | Resin Binder | | | | | | |
|---|---|---|---|---|---|---|---|
| | Amorhpous Polyester (A), Parts by Mass | Content of Aliphatic Diol (a) in Alcohol Component[1)], % by mol | Content of Aliphatic Diol (b) in Alcohol Component[1)], % by mol | Charge Control Resin, Parts by Mass[2)] | Charge Control Agent, Parts by Mass[2)] | Gloss | Background Fogging |
| Ex. C-1 | Resin C (100) | 70 | 30 | C-1 (6) | — | 18 | 0.03 |
| Ex. C-2 | Resin C (100) | 70 | 30 | C-1 (3) | C-2 (1) | 17 | 0.06 |
| Ex. C-3 | Resin C (100) | 70 | 30 | C-1 (6) | C-2 (1) | 18 | 0.02 |
| Ex. C-4 | Resin C (100) | 70 | 30 | C-1 (9) | C-2 (1) | 16 | 0.02 |
| Ex. C-5 | Resin B (100) | 60 | 40 | C-1 (6) | C-2 (1) | 18 | 0.03 |
| Ex. C-6 | Resin D (100) | 80 | 20 | C-1 (6) | C-2 (1) | 15 | 0.04 |
| Ex. C-7 | Resin E (100) | 90 | 10 | C-1 (6) | C-2 (1) | 13 | 0.08 |
| Ex. C-8 | Resin F (100) | 70 | 30 | C-1 (6) | C-2 (1) | 15 | 0.06 |
| Ex. C-9 | Resin G (100) | 70 | 30 | C-1 (6) | C-2 (1) | 17 | 0.03 |
| Ex. C-10 | Resin H (100) | 70 | 30 | C-1 (6) | C-2 (1) | 18 | 0.03 |
| Ex. C-11 | Resin I (100) | 60 | 25 | C-1 (6) | C-2 (1) | 15 | 0.07 |
| Ex. C-12 | Resin C (100) | 70 | 30 | C-1 (6) | C-2 (3) | 17 | 0.02 |
| Ex. C-13 | Resin C (100) | 70 | 30 | C-1 (6) | C-3 (1) | 18 | 0.03 |

TABLE C-3-continued

| | Resin Binder | | | | | | |
|---|---|---|---|---|---|---|---|
| | Amorhpous Polyester (A), Parts by Mass | Content of Aliphatic Diol (a) in Alcohol Component[1)], % by mol | Content of Aliphatic Diol (b) in Alcohol Component[1)], % by mol | Charge Control Resin, Parts by Mass[2)] | Charge Control Agent, Parts by Mass[2)] | Gloss | Background Fogging |
| Ex. C-14 | Resin C (85) Resin o (15) | 74.5 | 25.5 | C-1 (6) | C-2 (1) | 16 | 0.03 |
| Ex. C-15 | Resin C (100) | 70 | 30 | C-1 (6) | — | 18 | 0.06 |
| Ex. C-16 | Resin C (100) | 70 | 30 | C-1 (6) | C-2 (1) | 12 | 0.05 |

[1)]The content in the alcohol component of all the polyesters in the resin binder.
[2)]Parts by mass based on 100 parts by mass of the resin binder.

TABLE C-4

| | Resin Binder | | | | | | |
|---|---|---|---|---|---|---|---|
| | Amorhpous Polyester (A), Parts by Mass | Content of Aliphatic Diol (a) in Alcohol Component[1)], % by mol | Content of Aliphatic Diol (b) in Alcohol Component[1)], % by mol | Charge Control Resin, Parts by Mass[2)] | Charge Control Agent, Parts by Mass[2)] | Gloss | Background Fogging |
| Comp. Ex. C-1 | Resin A (100) | 40 | 60 | — | — | 13 | 0.25 |
| Comp. Ex. C-2 | Resin A (100) | 40 | 60 | — | C-2 (3) | 14 | 0.19 |
| Comp. Ex. C-3 | Resin A (100) | 40 | 60 | C-1 (11) | C-2 (1) | 8 | 0.02 |
| Comp. Ex. C-4 | Resin o (100) | 100 | 0 | C-1 (6) | C-2 (1) | 8 | 0.09 |
| Comp. Ex. C-5 | Resin p (100) | 0 | 30 | C-1 (6) | C-2 (1) | 7 | 0.08 |
| Comp. Ex. C-6 | Resin q (100) | 0 | 60 | C-1 (6) | C-2 (1) | 8 | 0.08 |

[1)]The content in the alcohol component of all the polyesters in the resin binder.
[2)]Parts by mass based on 100 parts by mass of the resin binder.

It can be seen from the above results that the toners of C-1 to C-16 have excellent gloss and suppression of background fogging, as compared to those of Comparative Examples C-1 to C-6.

The toner for electrostatic image development obtained according to the method of the present invention can be suitably used in developing latent images formed in, for example, an electrostatic development method, an electrostatic recording method, an electrostatic printing method, or the like.

What is claimed is:

1. A method for producing a toner for electrostatic image development comprising the step of melt-kneading a mixture comprising a resin binder and a wax, wherein the resin binder comprises an amorphous polyester (A) obtained by polycondensing an alcohol component comprising an aliphatic diol (a) having 3 or 4 carbon atoms, the aliphatic diol having a hydroxyl group bonded to a secondary carbon atom, and an aliphatic diol (b) comprising one or more α,ω-linear alkanediols having 2, 4, 6 or 8 carbon atoms, and a carboxylic acid component, a molar ratio of the aliphatic diol (a) to the aliphatic diol (b), i.e. aliphatic diol (a)/aliphatic diol (b), being from 95/5 to 55/45, and wherein the wax has a melting point of from 60° to 120° C., and a content of the wax being from 0.2 to 13 parts by mass, based on 100 parts by mass of the resin binder.

2. The method for producing a toner for electrostatic image development according to claim 1, wherein a total content of the aliphatic diol (a) and the aliphatic diol (b) is from 80% by mol or more of the alcohol component.

3. The method for producing a toner for electrostatic image development according to claim 1, wherein the aliphatic diol (b) is at least one member selected from the group consisting of 1,4-butanediol, 1,6-hexanediol, and 1,8-octanediol.

4. The method for producing a toner for electrostatic image development according to claim 1, wherein the molar ratio of the aliphatic diol (a) to the aliphatic diol (b), i.e. aliphatic diol (a)/aliphatic diol (b), is from 75/25 to 55/45.

5. The method for producing a toner for electrostatic image development according to claim 1, wherein the melting point of the wax is from 70° to 80° C.

6. The method for producing a toner for electrostatic image development according to claim 1, wherein the melt-kneading step is carried out in an open-roller type kneader.

7. The method for producing a toner for electrostatic image development according to claim 1, wherein the content of the amorphous polyester (A) is 80% by mass or more of the resin binder.

8. The method for producing a toner for electrostatic image development according to claim 1, wherein the aliphatic diol (a) is 1,2-propanediol.

9. The method for producing a toner for electrostatic image development according to claim 1, wherein the aliphatic diol (b) is 1,4-butanediol.

10. The method for producing a toner for electrostatic image development according to claim 1, wherein the resin binder comprises a crystalline resin and an amorphous resin, wherein the amorphous resin comprises the amorphous polyester (A).

11. The method for producing a toner for electrostatic image development according to claim 10, wherein a mass ratio of the amorphous resin to the crystalline resin, i.e. amorphous resin/crystalline resin, is from 55/45 to 95/5.

12. The method for producing a toner for electrostatic image development according to claim 1, wherein the mixture further comprises a charge control resin.

13. The method for producing a toner for electrostatic image development according to claim 12, wherein the mixture further comprises a charge control agent.

14. The method for producing a toner for electrostatic image development according to claim 12, wherein the charge control resin is a quaternary ammonium salt group-containing styrene-acrylic copolymer.

15. The method for producing a toner for electrostatic image development according to claim 12, wherein the content of the charge control resin is 1 part by mass or more and 10 parts by mass or less, based on 100 parts by mass of the resin binder.

16. The method for producing a toner for electrostatic image development according to claim 1, wherein the content of the aliphatic diol (b) is 15% by mol or more and 35% by mol or less of the alcohol component of the amorphous polyester (A).

17. The method for producing a toner for electrostatic image development according to claim 1, wherein the carboxylic acid component of the amorphous polyester (A) comprises a tricarboxylic or higher polycarboxylic acid compound, wherein the content of the tricarboxylic or higher polycarboxylic acid compound is 40% by mol or less of the carboxylic acid component.

18. The method for producing a toner for electrostatic image development according to claim 1, wherein the content of the wax is from 0.8 to 10 parts by mass, based on 100 parts by mass of the resin binder.

19. A toner for electrostatic image development obtained by the method of claim 1.

20. A method for producing a toner for electrostatic image development comprising the step of melt-kneading a mixture comprising a resin binder and a wax, wherein the resin binder comprises an amorphous polyester (A) obtained by polycondensing an alcohol component comprising 1,2-propanediol and 1,4-butanediol, and a carboxylic acid component, a molar ratio of 1,2-propanediol to 1,4-butanediol, i.e. 1,2-propanediol/1,4-butanediol, being from 75/25 to 55/45, and a total content of 1,2-propanediol and 1,4-butanediol in the alcohol component being 80% by mol or more, and wherein the wax has a melting point of from 70° to 80° C., and a content of the wax being from 0.8 to 10 parts by mass, based on 100 parts by mass of the resin binder, wherein the melt-kneading is carried out with an open roller-type kneader.

* * * * *